US009022505B2

(12) United States Patent
Ogura et al.

(10) Patent No.: US 9,022,505 B2
(45) Date of Patent: May 5, 2015

(54) PRINTING APPARATUS AND PRINTING METHOD

(71) Applicant: Seiko Epson Corporation, Tokyo (JP)

(72) Inventors: Masami Ogura, Tokyo-to (JP); Naoki Sudo, Shiojiri (JP)

(73) Assignee: Seiko Corporation, Tokyo (JP)

( * ) Notice: Subject to any disclaimer, the term of this patent is extended or adjusted under 35 U.S.C. 154(b) by 0 days.

(21) Appl. No.: 13/966,525

(22) Filed: Aug. 14, 2013

(65) Prior Publication Data

US 2014/0055516 A1 Feb. 27, 2014

(30) Foreign Application Priority Data

Aug. 22, 2012 (JP) ..... 2012-182990

(51) Int. Cl.
*B41J 2/21* (2006.01)

(52) U.S. Cl.
CPC . *B41J 2/21* (2013.01); *B41J 2/2107* (2013.01)

(58) Field of Classification Search
CPC .... B41J 2/17553; B41J 2/17503; B41J 2/145; B41J 2/175; B41J 2/21; B41J 2/205
USPC ..... 347/15, 40, 42, 43, 49, 85, 86
See application file for complete search history.

(56) References Cited

U.S. PATENT DOCUMENTS

| | | | | |
|---|---|---|---|---|
| 6,530,635 | B2 | 3/2003 | Otsuki | |
| 6,688,727 | B2 | 2/2004 | Otsuki | |
| 6,705,695 | B2 | 3/2004 | Otsuki | |
| 7,309,119 | B2 * | 12/2007 | Kojima | 347/43 |
| 7,537,298 | B2 * | 5/2009 | Oshio et al. | 347/9 |
| 8,651,640 | B2 * | 2/2014 | Hsueh et al. | 347/86 |
| 2009/0284559 | A1 | 11/2009 | Sudo et al. | |
| 2011/0187781 | A1 | 8/2011 | Oki et al. | |

FOREIGN PATENT DOCUMENTS

| | | | |
|---|---|---|---|
| JP | 2000-225719 | A | 8/2000 |
| JP | 2001-162841 | A | 6/2001 |
| JP | 2002-113852 | A | 4/2002 |
| JP | 2003-118097 | A | 4/2003 |
| JP | 2009-274280 | A | 11/2009 |
| JP | 2011-156715 | A | 8/2011 |

* cited by examiner

*Primary Examiner* — Thinh Nguyen
(74) *Attorney, Agent, or Firm* — Kilpatrick Townsend & Stockton LLP

(57) ABSTRACT

Provided is a printing method using a printing apparatus. The printing apparatus includes a head that has a nozzle array, in which a plurality of nozzles for ejecting a black pigment ink is arranged, and a nozzle array in which a plurality of nozzles for ejecting a color ink is arranged. The printing method includes: a step of acquiring image data of an image to be printed on a medium; a step of ejecting the black pigment ink onto the medium on the basis of the image data; and a step of ejecting the color ink onto the medium on the basis of the image data. A supply capability of the pigment ink supply section is higher than a supply capability of the color ink supply section.

20 Claims, 14 Drawing Sheets

| MODE | FEEDING DIRECTION | SPEED OF MOVEMENT OF CARRIAGE | TYPE OF BLACK INK | TYPE OF PRINTING PAPER P |
|---|---|---|---|---|
| FIRST MODE | BAND FEEDING | HIGH SPEED | PIGMENT (MK) | PLAIN PAPER |
| SECOND MODE | INTERLACED FEEDING | LOW SPEED | DYE (PK) | GLOSSY PAPER |

FIG. 8 METHOD OF FEEDING IN FIRST MODE

| PASS NUMBER | 1 | | 2 | | 3 | | 4 | | 5 | | 6 | | PRINTING RESULT | |
|---|---|---|---|---|---|---|---|---|---|---|---|---|---|---|
| | OUTGOING PATH → | | RETURNING ← PATH | | OUTGOING PATH → | | RETURNING ← PATH | | OUTGOING PATH → | | RETURNING ← PATH | | | |
| RASTER NUMBER | CMY | MK | CMY | MK | CMY | MK | CMY | MK | CMY | MK | CMY | MK | CMY | MK |
| 1 | 1 | 1 | | | | | | | | | | | OUTGOING 1 | OUTGOING 1 |
| 2 | | 2 | 1 | | | | | | | | | | RETURNING 1 | OUTGOING 2 |
| 3 | 2 | 3 | | | | | | | | | | | OUTGOING 2 | OUTGOING 3 |
| 4 | | 4 | 2 | | | | | | | | | | RETURNING 2 | OUTGOING 4 |
| 5 | 3 | 5 | | | | | | | | | | | OUTGOING 3 | OUTGOING 5 |
| 6 | | 6 | 3 | | | | | | | | | | RETURNING 3 | OUTGOING 6 |
| 7 | 4 | 7 | | | | | | | | | | | OUTGOING 4 | OUTGOING 7 |
| 8 | | 8 | 4 | | | | | | | | | | RETURNING 4 | OUTGOING 8 |
| 9 | 5 | 9 | | | | | | | | | | | OUTGOING 5 | OUTGOING 9 |
| 10 | | 10 | 5 | | | | | | | | | | RETURNING 5 | OUTGOING 10 |
| 11 | 6 | 11 | | | | | | | | | | | OUTGOING 6 | OUTGOING 11 |
| 12 | | 12 | 6 | | | | | | | | | | RETURNING 6 | OUTGOING 12 |
| 13 | 7 | 13 | | | | | | | | | | | OUTGOING 7 | OUTGOING 13 |
| 14 | | 14 | 7 | | | | | | | | | | RETURNING 7 | OUTGOING 14 |
| 15 | 8 | 15 | | | | | | | | | | | OUTGOING 8 | OUTGOING 15 |
| 16 | | 16 | 8 | | | | | | | | | | RETURNING 8 | OUTGOING 16 |
| 17 | 9 | 17 | | | | | | | | | | | OUTGOING 9 | OUTGOING 17 |
| 18 | | 18 | 9 | | | | | | | | | | RETURNING 9 | OUTGOING 18 |
| 19 | 10 | 19 | | | | | | | | | | | OUTGOING 10 | OUTGOING 19 |
| 20 | | 20 | 10 | | | | | | | | | | RETURNING 10 | OUTGOING 20 |
| 21 | | | | | 1 | 1 | | | | | | | OUTGOING 1 | OUTGOING 1 |
| 22 | | | | | | 2 | 1 | | | | | | RETURNING 1 | OUTGOING 2 |
| 23 | | | | | 2 | 3 | | | | | | | OUTGOING 2 | OUTGOING 3 |
| 24 | | | | | | 4 | 2 | | | | | | RETURNING 2 | OUTGOING 4 |
| 25 | | | | | 3 | 5 | | | | | | | OUTGOING 3 | OUTGOING 5 |
| 26 | | | | | | 6 | 3 | | | | | | RETURNING 3 | OUTGOING 6 |
| 27 | | | | | 4 | 7 | | | | | | | OUTGOING 4 | OUTGOING 7 |
| 28 | | | | | | 8 | 4 | | | | | | RETURNING 4 | OUTGOING 8 |
| 29 | | | | | 5 | 9 | | | | | | | OUTGOING 5 | OUTGOING 9 |
| 30 | | | | | | 10 | 5 | | | | | | RETURNING 5 | OUTGOING 10 |
| 31 | | | | | 6 | 11 | | | | | | | OUTGOING 6 | OUTGOING 11 |
| 32 | | | | | | 12 | 6 | | | | | | RETURNING 6 | OUTGOING 12 |
| 33 | | | | | 7 | 13 | | | | | | | OUTGOING 7 | OUTGOING 13 |
| 34 | | | | | | 14 | 7 | | | | | | RETURNING 7 | OUTGOING 14 |
| 35 | | | | | 8 | 15 | | | | | | | OUTGOING 8 | OUTGOING 15 |
| 36 | | | | | | 16 | 8 | | | | | | RETURNING 8 | OUTGOING 16 |
| 37 | | | | | 9 | 17 | | | | | | | OUTGOING 9 | OUTGOING 17 |
| 38 | | | | | | 18 | 9 | | | | | | RETURNING 9 | OUTGOING 18 |
| 39 | | | | | 10 | 19 | | | | | | | OUTGOING 10 | OUTGOING 19 |
| 40 | | | | | | 20 | 10 | | | | | | RETURNING 10 | OUTGOING 20 |
| 41 | | | | | | | | | 1 | 1 | | | OUTGOING 1 | OUTGOING 1 |
| 42 | | | | | | | | | | 2 | 1 | | RETURNING 1 | OUTGOING 2 |
| 43 | | | | | | | | | 2 | 3 | | | OUTGOING 2 | OUTGOING 3 |
| 44 | | | | | | | | | | 4 | 2 | | RETURNING 2 | OUTGOING 4 |
| 45 | | | | | | | | | 3 | 5 | | | OUTGOING 3 | OUTGOING 5 |
| 46 | | | | | | | | | | 6 | 3 | | RETURNING 3 | OUTGOING 6 |
| 47 | | | | | | | | | 4 | 7 | | | OUTGOING 4 | OUTGOING 7 |
| 48 | | | | | | | | | | 8 | 4 | | RETURNING 4 | OUTGOING 8 |
| 49 | | | | | | | | | 5 | 9 | | | OUTGOING 5 | OUTGOING 9 |
| 50 | | | | | | | | | | 10 | 5 | | RETURNING 5 | OUTGOING 10 |
| 51 | | | | | | | | | 6 | 11 | | | OUTGOING 6 | OUTGOING 11 |
| 52 | | | | | | | | | | 12 | 6 | | RETURNING 6 | OUTGOING 12 |
| 53 | | | | | | | | | 7 | 13 | | | OUTGOING 7 | OUTGOING 13 |
| 54 | | | | | | | | | | 14 | 7 | | RETURNING 7 | OUTGOING 14 |
| 55 | | | | | | | | | 8 | 15 | | | OUTGOING 8 | OUTGOING 15 |
| 56 | | | | | | | | | | 16 | 8 | | RETURNING 8 | OUTGOING 16 |
| 57 | | | | | | | | | 9 | 17 | | | OUTGOING 9 | OUTGOING 17 |
| 58 | | | | | | | | | | 18 | 9 | | RETURNING 9 | OUTGOING 18 |
| 59 | | | | | | | | | 10 | 19 | | | OUTGOING 10 | OUTGOING 19 |
| 60 | | | | | | | | | | 20 | 10 | | RETURNING 10 | OUTGOING 20 |

FIG. 9

METHOD OF FEEDING IN SECOND MODE

| PASS NUMBER | 1 | | 2 | | 3 | | 4 | | 5 | | PRINTING RESU_T | |
|---|---|---|---|---|---|---|---|---|---|---|---|---|
| RASTER NUMBER | OUTGOING PATH → | | | | | | | | | | | |
| | PK | CMY | | | | | | | | | PK | CMY |
| 1 | 1 | 1 | | | | | | | | | OUTGOING 1 | OUTGOING 1 |
| 2 | | | | | | | | | | | | |
| 3 | 2 | 2 | | | | | | | | | OUTGOING 2 | OUTGOING 2 |
| 4 | | | | | | | | | | | | |
| 5 | 3 | 3 | | | | | | | | | OUTGOING 3 | OUTGOING 3 |
| 6 | | | | | | | | | | | | |
| 7 | 4 | 4 | RETURNING ← PATH | | | | | | | | OUTGOING 4 | OUTGOING 4 |
| 8 | | | | | | | | | | | | |
| 9 | 5 | 5 | PK | CMY | | | | | | | OUTGOING 5 | OUTGOING 5 |
| 10 | | | 1 | 1 | | | | | | | RETURNING 1 | RETURNING 1 |
| 11 | 6 | 6 | | | | | | | | | OUTGOING 6 | OUTGOING 6 |
| 12 | | | 2 | 2 | | | | | | | RETURNING 2 | RETURNING 2 |
| 13 | 7 | 7 | | | | | | | | | OUTGOING 7 | OUTGOING 7 |
| 14 | | | 3 | 3 | | | | | | | RETURNING 3 | RETURNING 3 |
| 15 | 8 | 8 | | | | | | | | | OUTGOING 8 | OUTGOING 8 |
| 16 | | | 4 | 4 | | | | | | | RETURNING 4 | RETURNING 4 |
| 17 | 9 | 9 | | | | | | | | | OUTGOING 9 | OUTGOING 9 |
| 18 | | | 5 | 5 | OUTGOING PATH → | | | | | | RETURNING 5 | RETURNING 5 |
| 19 | 10 | 10 | | | | | | | | | OUTGOING 10 | OUTGOING 10 |
| 20 | | | 6 | 6 | PK | CMY | | | | | RETURNING 6 | RETURNING 6 |
| 21 | | | | | 1 | 1 | | | | | OUTGOING 1 | OUTGOING 1 |
| 22 | | | 7 | 7 | | | | | | | RETURNING 7 | RETURNING 7 |
| 23 | | | | | 2 | 2 | | | | | OUTGOING 2 | OUTGOING 2 |
| 24 | | | 8 | 8 | | | | | | | RETURNING 8 | RETURNING 8 |
| 25 | | | | | 3 | 3 | | | | | OUTGOING 3 | OUTGOING 3 |
| 26 | | | 9 | 9 | | | | | | | RETURNING 9 | RETURNING 9 |
| 27 | | | | | 4 | 4 | RETURNING ← PATH | | | | OUTGOING 4 | OUTGOING 4 |
| 28 | | | 10 | 10 | | | | | | | RETURNING 10 | RETURNING 10 |
| 29 | | | | | 5 | 5 | PK | CMY | | | OUTGOING 5 | OUTGOING 5 |
| 30 | | | | | | | 1 | 1 | | | RETURNING 1 | RETURNING 1 |
| 31 | | | | | 6 | 6 | | | | | OUTGOING 6 | OUTGOING 6 |
| 32 | | | | | | | 2 | 2 | | | RETURNING 2 | RETURNING 2 |
| 33 | | | | | 7 | 7 | | | | | OUTGOING 7 | OUTGOING 7 |
| 34 | | | | | | | 3 | 3 | | | RETURNING 3 | RETURNING 3 |
| 35 | | | | | 8 | 8 | | | | | OUTGOING 8 | OUTGOING 8 |
| 36 | | | | | | | 4 | 4 | | | RETURNING 4 | RETURNING 4 |
| 37 | | | | | 9 | 9 | | | | | OUTGOING 9 | OUTGOING 9 |
| 38 | | | | | | | 5 | 5 | OUTGOING PATH → | | RETURNING 5 | RETURNING 5 |
| 39 | | | | | 10 | 10 | | | | | OUTGOING 10 | OUTGOING 10 |
| 40 | | | | | | | 6 | 6 | PK | CMY | RETURNING 6 | RETURNING 6 |
| 41 | | | | | | | | | 1 | 1 | OUTGOING 1 | OUTGOING 1 |
| 42 | | | | | | | 7 | 7 | | | RETURNING 7 | RETURNING 7 |
| 43 | | | | | | | | | 2 | 2 | OUTGOING 2 | OUTGOING 2 |
| 44 | | | | | | | 8 | 8 | | | RETURNING 8 | RETURNING 8 |
| 45 | | | | | | | | | 3 | 3 | OUTGOING 3 | OUTGOING 3 |
| 46 | | | | | | | 9 | 9 | | | RETURNING 9 | RETURNING 9 |
| 47 | | | | | | | | | 4 | 4 | OUTGOING 4 | OUTGOING 4 |
| 48 | | | | | | | 10 | 10 | | | RETURNING 10 | RETURNING 10 |
| 49 | | | | | | | | | 5 | 5 | OUTGOING 5 | OUTGOING 5 |
| 50 | | | | | | | | | | | | |
| 51 | | | | | | | | | 6 | 6 | OUTGOING 6 | OUTGOING 6 |
| 52 | | | | | | | | | | | | |
| 53 | | | | | | | | | 7 | 7 | OUTGOING 7 | OUTGOING 7 |
| 54 | | | | | | | | | | | | |
| 55 | | | | | | | | | 8 | 8 | OUTGOING 8 | OUTGOING 8 |
| 56 | | | | | | | | | | | | |
| 57 | | | | | | | | | 9 | 9 | OUTGOING 9 | OUTGOING 9 |
| 58 | | | | | | | | | | | | |
| 59 | | | | | | | | | 10 | 10 | OUTGOING 10 | OUTGOING 10 |
| 60 | | | | | | | | | | | | |

COMPARATIVE EXAMPLE 1

COMPARATIVE EXAMPLE 2

COMPARATIVE EXAMPLE 3

PRINTING APPARATUS AND PRINTING METHOD

BACKGROUND

1. Technical Field

The present invention relates to a printing apparatus and a printing method.

2. Related Art

In the past, for example, as disclosed in JP-A-2011-156715, there has been a known printing apparatus in which a movement mode of a carriage is selected on the basis of whether the printing mode is a single color mode or a multi-color mode. Further, JP-A-2000-225719 discloses a printing method of selecting whether to perform printing using a black ink having a dye as a color material or using a black ink having a pigment as a color material, on the basis of whether the printing image data is color image data or black image data. Furthermore, in the disclosure of JP-A-2003-118097, in a case of printing an image in which a dot printing region, a blank region, a dot printing region are arranged in the sub-scanning direction, the number of sub-scanning operations is reduced by performing alignment feeding. Moreover, in the disclosure of JP-A-2001-162841, printing of the band feeding is performed for both black and color by a printing head in which each of a yellow nozzle array, a magenta nozzle array, and a cyan nozzle array is formed of a single nozzle line, and a black nozzle array is formed of two nozzle lines, or the printing of the band feeding is performed for black and the printing of the interlaced feeding is performed for color. In addition, JP-A-2009-274280 discloses a liquid ejecting apparatus which divisionally forms a raster region through a plurality of divided main scanning operations in accordance with delay of refilling.

However, in the liquid ejecting apparatus disclosed in JP-A-2009-274280, the main scanning for forming the raster region is divided into a plurality of operations. Thus, there is a problem in that it takes a long time to perform the printing. Furthermore, there are raster regions, which are formed through the plurality of divided main scanning operations, and raster regions which are formed without the divided main scanning operations. Thus, there is a problem in that unevenness occurs due to the difference between the times to form the raster regions. Further, none of JP-A-2011-156715, JP-A-2000-225719, JP-A-2003-118097, and JP-A-2001-162841 deals with the problem of delay of refilling. Hence, there has been a demand to perform high-speed printing regardless of the difference between modes according to whether the type of the printing medium is a plain paper or a glossy paper or whether the color material of the used ink has a dye or a pigment. Besides, there have been demands for high quality, usability, low costs, resource saving, ease of manufacture, and the like.

SUMMARY

The invention can be realized in the following forms or application examples.

Application Example 1

According to Application Example 1, there is provided a printing apparatus in which a pigment ink supplier for supplying a black pigment ink and a color ink supplier for supplying a color ink can be separately mounted. The printing apparatus includes: an acquiring section that acquires print data of an image to be printed on a medium; a pigment ink supply section that is supplied with the black pigment ink from the pigment ink supplier; a color ink supply section that is supplied with the color ink from the color ink supplier; a head that has a nozzle array, in which a plurality of nozzles for ejecting the black pigment ink supplied from the pigment ink supply section is arranged, and a nozzle array in which a plurality of nozzles for ejecting the color ink supplied from the color ink supply section is arranged; a scanning section that performs relative movement between the head and the medium in a main scanning direction which is orthogonal to a direction of the nozzle array; and a control section that causes the scanning section to perform the relative movement between the head and the medium in the main scanning direction on the basis of the print data. A supply capability of the pigment ink supply section is higher than a supply capability of the color ink supply section.

According to the printing apparatus of the application example, for example in a case of performing monochrome printing, or for example even in a case of performing color printing, the control to eject the black pigment ink (the black pigment ink is also referred to as a black ink) may be different from the control to eject the color ink. In this case, the supply capability of the pigment ink supply section is high, and the black pigment ink can be ejected continuously. Therefore, it is possible to perform printing at a high speed. In addition, regarding the ejection control, when the inks are ejected onto each unit area a plurality of times, it can be said that the ejection control operations are different if at least any one of specific factors of the control is different. The specific factors include the number of relative movements for the ejection in the main scanning direction, the speed of relative movement, the amount of ejected ink per single ejection operation, and the like.

Here, the supply capability of the ink supply section represents the maximum value of the volume of the ink which can be supplied per unit time (hereinafter the same). That is, in a case where the supply capability of the ink supply section is high, compared with a case of a low supply capability, the maximum value of the volume of the ink, which can be supplied per unit time, increases. Further, the volume of the ink, which is supplied from the ink supply section to the printing apparatus, depends on the volume of the ink which is consumed in the printing apparatus, but the supply capability of the ink supply section does not depend on the volume of the ink which is consumed in the printing apparatus. In this sense, the supply capability represents the maximum value of the volume of the ink which can be supplied per unit time. A case where the supply capability of the pigment ink supply section is higher than the supply capability of the color ink supply section includes, for example, a case where the number of pigment ink supply sections is larger than the number of color ink supply sections, and also includes a case where the diameter of the pigment ink supply section is larger than the diameter of the color ink supply section. Further, the magnitude of the diameter of the flow passage between the supply section and the nozzle array may be regarded as a level of the supply capability of the supply section, and the magnitude of the number of the flow passages between the supply sections and the nozzle arrays may be regarded as a level of the supply capability of the supply section. Further, in the definition of the supply capability of the ink supply section, it is assumed that the ink supplier, which is connected to the ink supply section, is able to supply the ink with a volume, which is equivalent to the supply capability of the ink supply section, per unit time.

Further, the supply capability of the color ink supply section represents the maximum value of the volume of a certain color ink of the color inks which can be supplied per unit time (hereinafter the same). That is, when the color inks have multiple colors like cyan, magenta, and yellow, the supply capability can be defined for each color. In addition, regarding the color ink, the color inks supplied from the color ink suppliers of different colors may be merged into one in the course of the flow passage subsequent to the ink supply section and may be ejected as a combined ink. In this case, the sum of the maximum values of the volumes of the inks, which can be supplied per unit time from the plurality of ink supply sections supplied with the inks from the color ink suppliers of different colors, is defined as a supply capability of the supply section for the combined color ink.

Furthermore, regarding the ink with the same color, there may be a plurality of sets each formed of the ink supplier, the ink supply section, and the nozzle array, and each set may be constituted by a separate flow passage. In this case, a unit, which defines the supply capability, is changed on the basis of whether or not the ink can be ejected such that the sets are compatible with each other in the relative movement in the main scanning direction. For example, in the single operation of the relative movement in the main scanning direction, the plurality of sets may be able to eject the ink onto pixels at the same positions in the print data (the sets may be compatible with each other in printing). In this case, the supply capability is defined on the basis of the sum of the supply capabilities of the sets. On the other hand, the timings, at which the ink is ejected through the time-division driving, may be different, or the positions of the nozzles of the sets may be different from each other. Hence, the plurality of sets may be unable to eject the ink onto the same positions in the print data (the sets may be incompatible with each other in printing). In this case, the supply capability is defined for each set even in the same color.

Further, the pigment ink represents an ink which contains the pigment as a color material (hereinafter the same). In addition, in the following description, the dye ink represents an ink which contains the dye as a color material (hereinafter the same). Furthermore, the color ink represents at least one of the inks of so-called cyan, magenta, yellow, and the like, and may be an ink other than the above-mentioned black ink (hereinafter the same).

Further, the relative movement is defined to include not only the movement of the head relative to the medium but also the movement of the medium relative to the head and the movement of both of them (hereinafter the same).

Application Example 2

In the printing apparatus according to Application Example 1, a dye ink supplier for supplying a black dye ink may be further mounted, a dye ink supply section, which is supplied with the black dye ink from the dye ink supplier, may be provided, and the head may have a nozzle array in which a plurality of nozzles for ejecting the black dye ink supplied from the dye ink supply section is arranged.

According to the printing apparatus of the application example, it is possible to eject the black pigment ink without ejecting the black dye ink or eject the black dye ink without ejecting the black pigment ink, in accordance with for example the type of the medium. Accordingly, it is possible to perform printing using the black ink according to the type of the medium, and therefore it is possible to perform printing with further higher quality.

Application Example 3

In the printing apparatus according to Application Example 2, the number of the pigment ink supply sections may be larger than the number of the dye ink supply sections.

According to the printing apparatus of the application example, the number of pigment ink supply sections is set to be larger than the number of the dye ink supply sections. Thereby, the supply capability of the pigment ink supply section can be set to be higher than the supply capability of the dye ink supply section. Accordingly, in accordance with for example the type of the medium, the black pigment ink may be ejected without ejection of the black dye ink, or the control to eject the black pigment ink may be different from the control to eject the black dye ink when the both black inks are ejected. In this case, the supply capability of the pigment ink supply section is high, and the black pigment ink is continuously ejected. Therefore, it is possible to perform printing at a high speed.

Application Example 4

In the printing apparatus according to Application Example 2 or 3, a diameter of the pigment ink supply section may be larger than a diameter of the dye ink supply section.

According to the printing apparatus of the application example, the diameter of the pigment ink supply section is set to be larger than the diameter of the dye ink supply section. Thereby, the supply capability of the pigment ink supply section can be set to be higher than the supply capability of the dye ink supply section. Accordingly, in accordance with for example the type of the medium, the black pigment ink may be ejected without ejection of the black dye ink, or the control to eject the black pigment ink may be different from the control to eject the black dye ink when the both black inks are ejected. In this case, the supply capability of the pigment ink supply section is high, and the black pigment ink is continuously ejected. Therefore, it is possible to perform printing at a high speed.

Application Example 5

In the printing apparatus according to any one of Application Examples 1 to 4, the number of the pigment ink supply sections may be larger than the number of the color ink supply sections.

According to the printing apparatus of the application example, the number of pigment ink supply sections is set to be larger than the number of color ink supply sections. Thereby, the supply capability of the pigment ink supply section is set to be higher than the supply capability of the color ink supply section. Accordingly, for example in the case of performing monochrome printing, or for example even in the case of performing color printing, the control to eject the black pigment ink may be different from the control to eject the color ink. In this case, the supply capability of the pigment ink supply section is high, and the black pigment ink can be ejected continuously. Therefore, it is possible to perform printing at a high speed.

Application Example 6

In the printing apparatus according to any one of Application Examples 1 to 5, a diameter of the pigment ink supply section may be larger than a diameter of the color ink supply section.

According to the printing apparatus of the application example, the diameter of the pigment ink supply section is set to be larger than the diameter of the color ink supply section. Thereby, the supply capability of the pigment ink supply section is set to be higher than the supply capability of the color ink supply section. Accordingly, for example in the case of performing monochrome printing, or for example even in the case of performing color printing, the control to eject the black pigment ink may be different from the control to eject the color ink. The supply capability of the pigment ink supply section is high, and the black pigment ink can be ejected continuously. Therefore, it is possible to perform printing at a high speed.

Application Example 7

In the printing apparatus according to any one of Application Examples 1 to 6, the head may have a plurality of nozzle arrays for ejecting the black pigment ink, and the plurality of nozzle arrays, which are for ejecting the black pigment ink, may eject the black pigment ink which is supplied from a single pigment ink supplier.

According to the printing apparatus of the application example, the single pigment ink supplier is able to supply the black pigment ink to the plurality of nozzle arrays. For example, the pigment ink suppliers, of which the number is equal to the number of the plurality of nozzle arrays respectively corresponding thereto, may supply the black pigment ink to the respective nozzle arrays. In this case, it is difficult to say that the amounts of remaining inks in the respective pigment ink suppliers are uniform. However, according to the application example, it is possible to reduce the differences between the amounts of the remaining inks, and thus it is possible to simplify replacement of the pigment ink suppliers, and it is possible to further improve usability.

Application Example 8

In the printing apparatus according to any one of Application Example 2 and Application Examples 3 to 7 referring to Application Example 2, the ink nozzle array for ejecting the color ink may be provided between one nozzle array for ejecting the black pigment ink and one nozzle array for ejecting the black dye ink in the main scanning direction.

According to the printing apparatus of the application example, for example, in the case of performing printing using the color ink and the black pigment ink, and in the case of performing printing using the color ink and the black dye ink, it is possible to change the range of the relative movement in the main scanning direction, in accordance with each case. That is, when the nozzle arrays for ejecting the color ink are located at both ends of the head in the main scanning direction, in either case, the head and the medium should be relatively moved from end to end of the head such that the printing can be performed through the nozzle arrays for ejecting the color ink. Thus, it is difficult to change the range of the relative movement, in accordance with each case. Consequently, according to the application example, it is possible to perform printing at a further higher speed. Further, for example, when the color ink is the dye ink, it is possible to eject the pigment ink before ejecting the dye ink in the relative movement in the main scanning direction. Accordingly, the pigment ink permeates into and spreads in the components of the dye ink which is ejected before the pigment ink is ejected, and thus it is possible to reduce deterioration in the color developing property of the black pigment ink. Consequently, it is possible to perform printing with further higher quality.

Application Example 9

In the printing apparatus according to any one of Application Examples 3 and 4 and Application Examples 5 to 8 referring to Application Example 3 or 4, the head may eject the color ink by an ejection capability which is equal to or less than the supply capability of the color ink supply section, and the head may eject the black pigment ink by an ejection capability which is equal to or less than the supply capability of the pigment ink supply section and which is greater than a supply capability of the dye ink supply section.

According to the printing apparatus of the application example, the head is prevented from ejecting an excessively large amount of the color ink relative to the supply capability of the color ink supply section, or from ejecting an excessively large or small amount of the black pigment ink relative to the supply capability of the pigment ink supply section, and it is possible to perform printing at a further higher speed. Here, the supply capability of the pigment ink supply section is higher than the supply capability of the dye ink supply section. Hence, if the black pigment ink is ejected by the ejection capability which is equal to or less than the supply capability of the dye ink supply section, it is assumed that an excessively small amount of the black pigment ink is ejected. Further, in the case where an excessively large amount of the ink is ejected, the supply capability does not reach the ejection capability. Hence, in order to prevent the printing from being actually stopped by the delay of refilling, it is necessary to form a raster region through a plurality of divided main scanning operations.

Here, the ejection capability represents the maximum value of the volume of the ink which can be ejected per unit time (hereinafter the same). That is, in the case where the ejection capability is high, compared with a case of a low ejection capability, the maximum value of the volume of the ink, which can be ejected per unit time, increases. Further, the volume of the ink, which is ejected from the nozzle array, depends on the print data of an image to be printed by the printing apparatus, but the ejection capability does not depend on the volume of the print data of the image to be printed by the printing apparatus. In this sense, the ejection capability represents the maximum value of the volume of the ink which can be ejected per unit time. The unit, which defines the ejection capability, is the same as the unit which defines the supply capability.

In order to specify the ejection capability for the black pigment ink, for example, printing may be performed on the basis of the following CMYK data of an image: each of C, M, Y, and K is 8-bit CMYK data; the image is a solid image which is formed of only pixels having values of C=0, M=0, Y=0, and K=255; the size of the image in the nozzle array direction is sufficiently longer than the length of the nozzle array; and the size of the image in the main scanning direction is 210 mm (corresponding to the length of the short side of the A4 size paper). In this case, the ejection capability may be regarded as a value which is obtained by dividing the volume of the black pigment ink, which is ejected in the single operation of the relative movement in the main scanning direction, by the time from the start to the end of the ejection of the black pigment ink in the single operation of the relative movement in the main scanning direction. In this case, even when the ink such as black dye ink or the color ink other than the black pigment ink is ejected, it is not considered in the ejection capability for the black pigment ink.

Further, it is the same for the ejection capability for the color ink. For example, the printing may be performed on the basis of the CMYK data which is the same as the above-mentioned CMYK data except C=0, M=0, Y=255, and K=0. In this case, the ejection capability for yellow ink may be regarded as a value which is obtained by dividing the volume of the yellow ink, which is ejected in the single operation of the relative movement in the main scanning direction, by the time from the start to the end of the ejection of the yellow ink in the single operation of the relative movement in the main scanning direction. It is also the same for the color inks other than the yellow ink. It should be noted that the ejection capability for the color ink is defined for each color in a similar manner to the supply capability of the ink supply section.

Furthermore, in the case of performing printing on the basis of the CMYK data of the solid image which is formed of only pixels having values of C=0, M=0, Y=0, and K=255, compared with the case of performing printing on the basis of CMYK data of a solid image which is formed of only pixels having values of C=0, M=0, Y=0, and K=0, a large amount of black ink is ejected.

Application Example 10

In the printing apparatus according to any one of Application Examples 3 and 4 and Application Examples 5 to 9 referring to Application Example 3 or 4, the control section may cause the head to eject inks onto the medium, on the basis of the print data and a certain mode among a plurality of modes including a first mode for ejecting the black pigment ink and a second mode for ejecting the black dye ink. In addition, the second mode may be a mode for ejecting the black dye ink by an ejection capability which is equal to or less than the supply capability of the dye ink supply section. In addition, the first mode may be a mode for ejecting the black pigment ink by an ejection capability which is equal to or less than the supply capability of the pigment ink supply section and which is greater than a supply capability of the dye ink supply section.

According to the printing apparatus of the application example, none of the first mode for ejecting the black pigment ink and the second mode for ejecting the black dye ink is a mode for ejecting an excessively larger amount of the ink relative to the supply capability of the ink supply section. Hence, in a case of performing printing in either mode, it is possible to perform printing at a high speed. Further, in the case of ejecting the black pigment ink, an excessively small amount of the ink is prevented from being ejected. Hence, it is possible to perform printing at a high speed. Further, it is possible to selectively switch between the first mode for ejecting the black pigment ink and the second mode for ejecting the black dye ink. Therefore, it is possible to perform printing according to the type of each ink, and it is possible to perform printing with further higher quality.

Here, in order to specify the ejection capability for the black dye ink, for example, printing may be performed on the basis of the following CMYK data of an image: each of C, M, Y, and K is 8-bit CMYK data; the image is a solid image which is formed of only pixels having values of C=0, M=0, Y=0, and K=255; the size of the image in the nozzle array direction is sufficiently longer than the length of the nozzle array; and the size of the image in the main scanning direction is 210 mm (corresponding to the length of the short side of the A4 size paper). In this case, the ejection capability may be regarded as a value which is obtained by dividing the volume of the black dye ink, which is ejected in the single operation of the relative movement in the main scanning direction, by the time from the start to the end of the ejection of the black dye ink in the single operation of the relative movement in the main scanning direction. In this case, even when the ink such as black pigment ink or the color ink other than the black dye ink is ejected, it is not considered in the ejection capability for the black dye ink.

Application Example 11

In the printing apparatus according to Application Example 10, a speed of relative movement in the main scanning direction in the first mode may be higher than a speed of relative movement in the main scanning direction in the second mode.

According to the printing apparatus of the application example, the speed of relative movement is changed on the basis of the level of the supply capability. Thereby, in the first mode, it is possible to perform printing at a further higher speed.

Here, the speed of the relative movement in the main scanning direction represents a constant speed if the speed of the relative movement in the main scanning direction during printing is constant, or represents the maximum speed if the speed is not constant (hereinafter the same).

Application Example 12

The printing apparatus according to Application Example 10 or 11 may further include a moving section that performs the relative movement between the head and the medium in the nozzle array direction. The control section may cause the moving section to perform relative movement between the head and the medium in the nozzle array direction, on the basis of the print data and a certain mode among the plurality of modes, and may cause the moving section to perform relative movement in a nozzle array direction, on the basis of the print data for printing the image, of which the length is twice the length of the nozzle array in the nozzle array direction, on the medium. In this case, a maximum value of an amount of the relative movement in the nozzle array direction in the first mode may be larger than a maximum value of an amount of the relative movement in the nozzle array direction in the second mode.

According to the printing apparatus of the application example, the maximum value of the amount of the relative movement in the nozzle array direction in the first mode is set to be larger than that in the second mode, and the mode can be selected in accordance with a purpose such as an increase in speed or an increase in quality. Therefore, it is possible to further improve usability.

Here, when printing is performed on the basis of the print data of the image of which the length is twice the length of the nozzle array in the nozzle array direction, a plurality of operations of the relative movement in the main scanning direction and at least a single operation of the relative movement in the nozzle array direction are necessary. At this time, when the maximum values of the amounts of the relative movement in the nozzle array direction are different, methods of forming dots on the medium for each single operation of the relative movement in the main scanning direction become different. For example, in a case of performing printing through so-called band feeding, compared with a case of performing printing through so-called interlaced feeding, the maximum value of the feeding amount is large. In addition, in the most cases of performing printing through so-called band feeding, compared with the case of performing printing through so-called interlaced feeding, printing is generally performed at a high speed. On the other hand, in the most cases of performing printing through so-called interlaced feeding, compared with the case of performing printing through so-called band feeding, printing is generally performed with high quality. Accordingly, when the maximum values of the amounts of the relative movement in the nozzle array direction are different, it is possible to select the mode in accordance with the purpose such as an increase in speed or an increase in quality.

Application Example 13

In the printing apparatus according to any one of Application Examples 10 to 12, the relative movement in the first mode may include a first relative movement from one side to the other side in the main scanning direction, and a second relative movement from the other side to the one side in the main scanning direction. In the first relative movement, the black pigment ink and the color ink are respectively ejected. In the second relative movement, the color ink is ejected without ejection of the black pigment ink. In addition, the relative movement in the second mode may include a third relative movement from the one side to the other side in the main scanning direction, and a fourth relative movement from the other side to the one side in the main scanning direction. In the third relative movement, the black dye ink and the color ink are respectively ejected. In the fourth relative movement, the black dye ink and the color ink are respectively ejected. The nozzle array for ejecting the black pigment ink may be closer to the other side than the nozzle array for ejecting the color ink in the main scanning direction.

According to the printing apparatus of the application example, appropriate printing can be performed for each of the case where the black pigment ink is ejected and the case where the black dye ink is ejected. Therefore, even in either mode, it is possible to perform printing with further higher quality.

Further, for example, when the color ink is a dye ink, in the first mode, it is possible to eject the pigment ink before ejecting the dye ink in the relative movement in the main scanning direction. Accordingly, the pigment ink permeates into and spreads in the components of the dye ink which is ejected before the pigment ink is ejected, and thus it is possible to reduce deterioration in the color developing property of the pigment ink. Accordingly, it is possible to perform printing with further higher quality.

Application Example 14

According to Application Example 14, there is provided a printing apparatus in which a pigment ink supplier for supplying a black pigment ink and a dye ink supplier for supplying a black dye ink can be separately mounted. The printing apparatus includes: an acquiring section that acquires print data of an image to be printed on a medium; a pigment ink supply section that is supplied with the black pigment ink from the pigment ink supplier; a dye ink supply section that is supplied with the black dye ink from the dye ink supplier; a head that has a nozzle array, in which a plurality of nozzles for ejecting the black pigment ink supplied from the pigment ink supply section is arranged, and a nozzle array in which a plurality of nozzles for ejecting the black dye ink supplied from the dye ink supply section is arranged; a scanning section that performs relative movement between the head and the medium in a main scanning direction which is orthogonal to a direction of the nozzle array; and a control section that causes the scanning section to perform the relative movement between the head and the medium in the main scanning direction on the basis of the print data. A supply capability of the pigment ink supply section is higher than a supply capability of the dye ink supply section.

According to the printing apparatus of the application example, in accordance with for example the type of the medium, the black pigment ink may be ejected without ejection of the black dye ink, or the control to eject the black pigment ink may be different from the control to eject the black dye ink when the both black inks are ejected. In this case, the supply capability of the pigment ink supply section is high, and the black pigment ink is continuously ejected. Therefore, it is possible to perform printing at a high speed.

Application Example 15

In the printing apparatus according to Application Example 14, the head may have a plurality of nozzle arrays for ejecting the black pigment ink, and the plurality of nozzle arrays, which are for ejecting the black pigment ink, may eject the black pigment ink which is supplied from the single pigment ink supplier.

According to the printing apparatus of the application example, the single pigment ink supplier is able to supply the black pigment ink to the plurality of nozzle arrays. For example, the pigment ink suppliers, of which the number is equal to the number of the plurality of nozzle arrays respectively corresponding thereto, may supply the black pigment ink to the respective nozzle arrays. In this case, it is difficult to say that the amounts of remaining inks in the respective pigment ink suppliers are uniform. However, according to the application example, it is possible to reduce the differences between the amounts of the remaining inks, and thus it is possible to simplify replacement of the pigment ink suppliers, and it is possible to further improve usability.

Application Example 16

In the printing apparatus according to Application Example 14 or 15, the number of the pigment ink supply sections may be larger than the number of the dye ink supply sections.

According to the printing apparatus of the application example, the number of pigment ink supply sections is set to be larger than the number of the dye ink supply sections. Thereby, the supply capability of the pigment ink supply section can be set to be higher than the supply capability of the dye ink supply section. Accordingly, in accordance with for example the type of the medium, the black pigment ink may be ejected without ejection of the black dye ink, or the control to eject the black pigment ink may be different from the control to eject the black dye ink when the both black inks are ejected. In this case, the supply capability of the pigment ink supply section is high, and the black pigment ink is continuously ejected. Therefore, it is possible to perform printing at a high speed.

Application Example 17

In the printing apparatus according to any one of Application Examples 14 to 16, a diameter of the pigment ink supply section may be larger than a diameter of the dye ink supply section.

According to the printing apparatus of the application example, the diameter of the pigment ink supply section is set to be larger than the diameter of the dye ink supply section. Thereby, the supply capability of the pigment ink supply section can be set to be higher than the supply capability of the dye ink supply section. Accordingly, in accordance with for example the type of the medium, the black pigment ink may be ejected without ejection of the black dye ink, or the control to eject the black pigment ink may be different from the control to eject the black dye ink when the both black inks are ejected. In this case, the supply capability of the pigment ink supply section is high, and the black pigment ink is continuously ejected. Therefore, it is possible to perform printing at a high speed.

Application Example 18

In the printing apparatus according to any one of Application Examples 14 to 17, the control section may cause the head to eject inks onto the medium, on the basis of the print data and a certain mode among a plurality of modes including a first mode for ejecting the black pigment ink and a second mode for ejecting the black dye ink. In addition, the second mode may be a mode for ejecting the black dye ink by an ejection capability which is equal to or less than the supply capability of the dye ink supply section. In addition, the first mode may be a mode for ejecting the black pigment ink by an ejection capability which is equal to or less than the supply capability of the pigment ink supply section and which is greater than a supply capability of the dye ink supply section.

According to the printing apparatus of the application example, none of the first mode for ejecting the black pigment ink and the second mode for ejecting the black dye ink is a mode for ejecting an excessively larger amount of the ink relative to the supply capability of the ink supply section. Hence, in a case of performing printing in either mode, it is possible to perform printing at a high speed. Further, in the case of ejecting the black pigment ink, an excessively small amount of the ink is prevented from being ejected. Hence, it is possible to perform printing at a high speed. Further, it is possible to selectively switch between the first mode for ejecting the black pigment ink and the second mode for ejecting the black dye ink. Therefore, it is possible to perform printing according to the type of each ink, and it is possible to perform printing with further higher quality.

Application Example 19

In the printing apparatus according to Application Example 18, a speed of relative movement in the main scanning direction in the first mode may be higher than a speed of relative movement in the main scanning direction in the second mode.

According to the printing apparatus of the application example, the speed of relative movement is changed on the basis of the level of the supply capability. Thereby, in the first mode, it is possible to perform printing at a further higher speed.

Application Example 20

The printing apparatus according to Application Example 18 or 19 may further include a moving section that performs the relative movement between the head and the medium in the nozzle array direction. The control section may cause the moving section to perform relative movement between the head and the medium in the nozzle array direction, on the basis of the print data and a certain mode among the plurality of modes, and may cause the moving section to perform relative movement in a nozzle array direction, on the basis of the print data for printing the image, of which the length is twice the length of the nozzle array in the nozzle array direction, on the medium. In this case, a maximum value of an amount of the relative movement in the nozzle array direction in the first mode may be larger than a maximum value of an amount of the relative movement in the nozzle array direction in the second mode.

According to the printing apparatus of the application example, the maximum value of the amount of the relative movement in the nozzle array direction in the first mode is set to be larger than that in the second mode, and the mode can be selected in accordance with a purpose such as an increase in speed or an increase in quality. Therefore, it is possible to further improve usability.

Application Example 21

In the printing apparatus according to any one of Application Examples 14 to 20, a color ink supplier for supplying a color ink may be further mounted, a color ink supply section, which is supplied with the color ink from the color ink supplier, may be provided, and the head may have a nozzle array in which a plurality of nozzles for ejecting the color ink supplied from the color ink supply section is arranged.

According to the printing apparatus of the application example, for example, monochrome printing may be performed, or color printing may be performed. Accordingly, it is possible to perform printing with high quality.

Application Example 22

In the printing apparatus according to Application Example 21, the ink nozzle array for ejecting the color ink may be provided between one nozzle array for ejecting the black pigment ink and one nozzle array for ejecting the black dye ink in the main scanning direction.

According to the printing apparatus of the application example, for example, in the case of performing printing using the color ink and the black pigment ink, and in the case of performing printing using the color ink and the black dye ink, it is possible to change the range of the relative movement in the main scanning direction, in accordance with each case. That is, when the nozzle arrays for ejecting the color ink are located at both ends of the head in the main scanning direction, in either case, the head and the medium should be relatively moved from end to end of the head such that the printing can be performed through the nozzle arrays for ejecting the color ink. Thus, it is difficult to change the range of the relative movement, in accordance with each case. Accordingly, according to the application example, it is possible to perform printing at a further higher speed. Further, for example, when the color ink is the dye ink, it is possible to eject the pigment ink before ejecting the dye ink in the relative movement in the main scanning direction. Accordingly, the pigment ink permeates into and spreads in the components of the dye ink which is ejected before the pigment ink is ejected, and thus it is possible to reduce deterioration in the color developing property of the pigment ink. Accordingly, it is possible to perform printing with further higher quality.

Application Example 23

In the printing apparatus according to Application Example 21 or 22, the number of the pigment ink supply sections may be larger than the number of the color ink supply sections.

According to the printing apparatus of the application example, the number of pigment ink supply sections is set to be larger than the number of color ink supply sections. Thereby, the supply capability of the pigment ink supply section is set to be higher than the supply capability of the color ink supply section. Accordingly, for example in the case of performing monochrome printing, or for example even in the case of performing color printing, the control to eject the black pigment ink may be different from the control to eject the color ink. The supply capability of the pigment ink supply section is high, and the black pigment ink can be ejected continuously. Therefore, it is possible to perform printing at a high speed.

Application Example 24

In the printing apparatus according to any one of Application Examples 21 to 23, a diameter of the pigment ink supply section may be larger than a diameter of the color ink supply section.

According to the printing apparatus of the application example, the diameter of the pigment ink supply section is set to be larger than the diameter of the color ink supply section. Thereby, the supply capability of the pigment ink supply section is set to be higher than the supply capability of the color ink supply section. Accordingly, for example in the case of performing monochrome printing, or for example even in the case of performing color printing, the control to eject the black pigment ink may be different from the control to eject the color ink. The supply capability of the pigment ink supply section is high, and the black pigment ink can be ejected continuously. Therefore, it is possible to perform printing at a high speed.

Application Example 25

In the printing apparatus according to any one of Application Examples 21 to 24, the head may eject the color ink by an ejection capability which is equal to or less than the supply capability of the color ink supply section, and the head may eject the black pigment ink by an ejection capability which is equal to or less than the supply capability of the pigment ink supply section and which is greater than a supply capability of the color ink supply section.

According to the printing apparatus of the application example, the head is prevented from ejecting an excessively large amount of the color ink relative to the supply capability of the color ink supply section, or from ejecting an excessively large or small amount of the black pigment ink relative to the supply capability of the pigment ink supply section, and it is possible to perform printing at a further higher speed.

Application Example 26

In the printing apparatus according to any one of Application Examples 21 to 25 referring to Application Example 18, the relative movement in the first mode may include a first relative movement from one side to the other side in the main scanning direction, and a second relative movement from the other side to the one side in the main scanning direction. In the first relative movement, the black pigment ink and the color ink are respectively ejected. In the second relative movement, the color ink is ejected without ejection of the black pigment ink. In addition, the relative movement in the second mode may include a third relative movement from the one side to the other side in the main scanning direction, and a fourth relative movement from the other side to the one side in the main scanning direction. In the third relative movement, the black dye ink and the color ink are respectively ejected. In the fourth relative movement, the black dye ink and the color ink are respectively ejected. The nozzle array for ejecting the black pigment ink may be closer to the other side than the nozzle array for ejecting the color ink in the main scanning direction.

According to the printing apparatus of the application example, appropriate printing can be performed for each of the case where the black pigment ink is ejected and the case where the black dye ink is ejected. Therefore, even in either mode, it is possible to perform printing with further higher quality. Further, for example, in the first mode, it is possible to eject the pigment ink before ejecting the dye ink in the relative movement in the main scanning direction. Accordingly, the pigment ink permeates into and spreads in the components of the dye ink which is ejected before the pigment ink is ejected, and thus it is possible to reduce deterioration in the color developing property of the pigment ink. Accordingly, it is possible to perform printing with further higher quality.

Application Example 27

According to Application Example 27, there is provided a printing apparatus in which a first ink supplier for supplying a first ink and a second ink supplier for supplying a second ink can be separately mounted. The printing apparatus includes: an acquiring section that acquires print data of an image to be printed on a medium; a first ink supply section that is supplied with the first ink from the first ink supplier; a second ink supply section that is supplied with the second ink from the second ink supplier; a head that has a nozzle array, in which a plurality of nozzles for ejecting the first ink supplied from the first ink supply section is arranged, and a nozzle array in which a plurality of nozzles for ejecting the second ink supplied from the second ink supply section is arranged; a scanning section that performs relative movement between the head and the medium in a main scanning direction which is orthogonal to a direction of the nozzle array; and a control section that causes the scanning section to perform the relative movement between the head and the medium in the main scanning direction, the control section causing the head to eject inks onto a medium on the basis of print data and a certain mode among a plurality of modes including a first mode for ejecting the first ink and a second mode for ejecting the second ink. A supply capability of the first ink supply section is higher than a supply capability of the second ink supply section. The second mode is a mode for ejecting the second ink by an ejection capability which is equal to or less than the supply capability of the second ink supply section. The first mode is a mode for ejecting the first ink by an ejection capability which is equal to or less than the supply capability of the first ink supply section and which is greater than a supply capability of the second ink supply section.

According to the printing apparatus of the application example, in accordance with for example the type of the medium, the type of the ink to be ejected may be changed, or the control to eject the first ink may be different from the control to eject the second ink when both types of inks are ejected. In this case, the supply capability of the first ink supply section is high, and the first ink is continuously ejected. Therefore, it is possible to perform printing at a high speed.

Application Example 28

In the printing apparatus according to Application Example 27, a speed of relative movement in the main scanning direction in the first mode may be higher than a speed of relative movement in the main scanning direction in the second mode.

According to the printing apparatus of the application example, the supply capability of the first ink supply section is higher than the supply capability of the second ink supply section. On the basis of this, in the first mode, it is possible to perform printing at a further higher speed.

Application Example 29

The printing apparatus according to Application Example 27 or 28 may further include a moving section that performs the relative movement between the head and the medium in the nozzle array direction. The control section may cause the moving section to perform relative movement between the head and the medium in the nozzle array direction, on the basis of the print data and a certain mode among the plurality of modes, and may cause the moving section to perform relative movement in a nozzle array direction, on the basis of the print data for printing the image, of which the length is twice the length of the nozzle array in the nozzle array direction, on the medium. In this case, a maximum value of an amount of the relative movement in the nozzle array direction in the first mode may be larger than a maximum value of an amount of the relative movement in the nozzle array direction in the second mode.

According to the printing apparatus of the application example, the maximum value of the amount of the relative movement in the nozzle array direction in the first mode is set to be larger than that in the second mode, and the mode can be selected in accordance with a purpose such as an increase in speed or an increase in quality. Therefore, it is possible to further improve usability.

Application Example 30

In the printing apparatus according to any one of Application Examples 27 to 29, the head may have a plurality of nozzle arrays for ejecting the first ink, and the plurality of nozzle arrays for ejecting the first ink may eject the first ink which is supplied from the single first ink supplier.

According to the printing apparatus of the application example, the single first ink supplier is able to supply the first ink to the plurality of nozzle arrays. For example, the first ink suppliers, of which the number is equal to the number of the plurality of nozzle arrays respectively corresponding thereto, may supply the first ink to the respective nozzle arrays. In this case, it is difficult to say that the amounts of remaining inks in the respective first ink suppliers are uniform. However, according to the application example, it is possible to reduce the differences between the amounts of the remaining inks, and thus it is possible to simplify replacement of the first ink suppliers, and it is possible to further improve usability.

Application Example 31

In the printing apparatus according to any one of Application Examples 27 to 30, the number of the first ink supply sections may be larger than the number of the second ink supply sections.

According to the printing apparatus of the application example, the number of first ink supply sections is set to be larger than the number of the second ink supply sections. Thereby, the supply capability of the first ink supply section can be set to be higher than the supply capability of the second ink supply section. Accordingly, in accordance with for example the type of the medium, the first ink may be ejected without ejection of the second ink, or the control to eject the first ink may be different from the control to eject the second ink when both types of inks are ejected. In this case, the supply capability of the first ink supply section is high, and the first ink is continuously ejected. Therefore, it is possible to perform printing at a high speed.

Application Example 32

In the printing apparatus according to any one of Application Examples 27 to 31, a diameter of the first ink supply section may be larger than a diameter of the second ink supply section.

According to the printing apparatus of the application example, the diameter of the first ink supply section is set to be larger than the diameter of the second ink supply section. Thereby, the supply capability of the first ink supply section can be set to be higher than the supply capability of the second ink supply section. Accordingly, in accordance with for example the type of the medium, the first ink may be ejected without ejection of the second ink, or the control to eject the first ink may be different from the control to eject the second ink when both types of inks are ejected. In this case, the supply capability of the first ink supply section is high, and the first ink is continuously ejected. Therefore, it is possible to perform printing at a high speed.

Application Example 33

In the printing apparatus according to any one of Application Examples 27 to 32, a third ink supplier for supplying a third ink may be further mounted. In the printing apparatus, a third ink supply section, which is supplied with the third ink from the third ink supplier, may be provided. The head may have a nozzle array in which a plurality of nozzles for ejecting the third ink supplied from the third ink supply section is arranged. The ink nozzle array for ejecting the third ink may be provided between one nozzle array for ejecting the first ink and one nozzle array for ejecting the second ink in the main scanning direction. The control section may perform control to eject the first ink and the third ink in the first mode, and may perform control to eject the second ink and the third ink in the second mode.

According to the printing apparatus of the application example, for example, in the case of performing printing using the third ink and the first ink, and in the case of performing printing using the third ink and the second ink, it is possible to change the range of the relative movement in the main scanning direction, in accordance with each case. That is, when the nozzle arrays for ejecting the third ink are located at both ends of the head in the main scanning direction, in either case, the head and the medium should be relatively moved from end to end of the head such that the printing can be performed through the nozzle arrays for ejecting the third ink. Thus, it is difficult to change the range of the relative movement, in accordance with each case. Consequently, according to the application example, it is possible to perform printing at a further higher speed. Further, for example, in the relative movement in the main scanning direction, it is possible to eject the first ink before ejecting the second ink, or it is possible to eject the second ink before ejecting the first ink.

Application Example 34

In the printing apparatus according to Application Example 33, the number of the first ink supply sections may be larger than the number of the third ink supply sections.

According to the printing apparatus of the application example, the number of first ink supply sections is set to be larger than the number of third ink supply sections. Thereby, the supply capability of the first ink supply section is set to be higher than the supply capability of the third ink supply section. Accordingly, for example in the case of performing printing using only the first ink, or for example even in the case of performing printing using both inks, the control operations to eject the inks may be different. In this case, the supply capability of the first ink supply section is high, and the first ink can be ejected continuously. Therefore, it is possible to perform printing at a high speed.

Application Example 35

In the printing apparatus according to Application Example 33 or 34, a diameter of the first ink supply section may be larger than a diameter of the third ink supply section.

According to the printing apparatus of the application example, the diameter of the first ink supply section is set to be larger than the diameter of the third ink supply section. Thereby, the supply capability of the first ink supply section is set to be higher than the supply capability of the third ink supply section. Accordingly, for example in the case of performing printing using only the first ink, or for example even in the case of performing printing using both inks, the control operations to eject the inks may be different. In this case, the supply capability of the first ink supply section is high, and the first ink can be ejected continuously. Therefore, it is possible to perform printing at a high speed.

Application Example 36

The head may eject the third ink by an ejection capability which is equal to or less than the supply capability of the third ink supply section, and the head may eject the first ink by an ejection capability which is equal to or less than the supply capability of the first ink supply section and which is greater than a supply capability of the third ink supply section.

According to the printing apparatus of the application example, the head is prevented from ejecting an excessively large amount of the third ink relative to the supply capability of the third ink supply section, or from ejecting an excessively large or small amount of the first ink relative to the supply capability of the first ink supply section, and it is possible to perform printing at a further higher speed.

Application Example 37

In the printing apparatus according to Application Example 36, the relative movement in the first mode may include a first relative movement from one side to the other side in the main scanning direction, and a second relative movement from the other side to the one side in the main scanning direction. In the first relative movement, the first ink and the third ink are respectively ejected. In the second relative movement, the third ink is ejected without ejection of the first ink. In addition, the relative movement in the second mode may include a third relative movement from the one side to the other side in the main scanning direction, and a fourth relative movement from the other side to the one side in the main scanning direction. In the third relative movement, the second ink and the third ink are respectively ejected. In the fourth relative movement, the second ink and the third ink are respectively ejected.

According to the printing apparatus of the application example, appropriate printing can be performed for each of the case where the first ink is ejected and the case where the second ink is ejected. Therefore, even in either mode, it is possible to perform printing with further higher quality. Further, for example, in the first mode, it is possible to eject the first ink before ejecting the second ink in the relative movement in the main scanning direction. Accordingly, it is possible to perform printing with further higher quality.

Application Example 38

In the printing apparatus according to Application Example 37, the nozzle array for ejecting the first ink may be closer to the other side than the nozzle array for ejecting the third ink in the main scanning direction.

According to the printing apparatus of the application example, in the first mode, it is possible to eject the first ink before ejecting the second ink. Accordingly, it is possible to perform printing with further higher quality.

Application Example 39

According to Application Example 39, there is provided a printing method using a printing apparatus. The printing apparatus includes a head that has a nozzle array, in which a plurality of nozzles for ejecting a black pigment ink is arranged, and a nozzle array in which a plurality of nozzles for ejecting a color ink is arranged. The printing method includes: a step of acquiring print data of an image to be printed on a medium; a step of ejecting the black pigment ink, which is supplied through a pigment ink supply section of the printing apparatus from a pigment ink supplier for supplying the black pigment ink, onto the medium on the basis of the print data; and a step of ejecting the color ink, which is supplied through a color ink supply section of the printing apparatus from a color ink supplier for supplying the color ink, onto the medium on the basis of the print data. A supply capability of the pigment ink supply section is higher than a supply capability of the color ink supply section.

According to the printing method of the application example, for example in the case of performing monochrome printing, or for example even in the case of performing color printing, the control to eject the black pigment ink may be different from the control to eject the color ink. The supply capability of the pigment ink supply section is high, and the black pigment ink can be ejected continuously. Therefore, it is possible to perform printing at a high speed.

Application Example 40

According to Application Example 40, there is provided a printing method using a printing apparatus. The printing apparatus includes a head that has a nozzle array, in which a plurality of nozzles for ejecting a black pigment ink is arranged, and a nozzle array in which a plurality of nozzles for ejecting a black dye ink is arranged. The printing method includes: a step of acquiring print data of an image to be printed on a medium; a step of ejecting the black pigment ink, which is supplied through a pigment ink supply section of the printing apparatus from a pigment ink supplier for supplying the black pigment ink, onto the medium on the basis of the print data; and a step of ejecting the black dye ink, which is supplied through a dye ink supply section of the printing apparatus from a dye ink supplier for supplying the black dye ink, onto the medium on the basis of the print data. A supply capability of the pigment ink supply section is higher than a supply capability of the dye ink supply section.

According to the printing apparatus of the application example, in accordance with for example the type of the medium, the black pigment ink may be ejected without ejection of the black dye ink, or the control to eject the black pigment ink may be different from the control to eject the black dye ink when the both black inks are ejected. In this case, the supply capability of the pigment ink supply section is high, and the black pigment ink is continuously ejected. Therefore, it is possible to perform printing at a high speed.

Application Example 41

According to Application Example 41, there is provided a printing method using a printing apparatus. The printing apparatus includes a head that has a nozzle array in which a plurality of nozzles for ejecting an ink is arranged. The printing method includes: a step of acquiring print data of an image to be printed on a medium; and a step of ejecting the ink, which is supplied through an ink supply section from an ink supplier for ejecting the ink, onto the medium on the basis of the print data. In the step of ejecting, when there are a plurality of modes including a first mode for ejecting the first ink and a second mode for ejecting the second ink and the ink is ejected on the basis of the first mode among the plurality of modes, the first ink, which is supplied through a first ink supply section from the first ink supplier for supplying the first ink, is ejected. When the ink is ejected on the basis of the second mode, the second ink, which is supplied through a second ink supply section from the second ink supplier for supplying the second ink, is ejected. A supply capability of the first ink supply section is higher than a supply capability of the second ink supply section. The second mode is a mode for ejecting the second ink by an ejection capability which is equal to or less than the supply capability of the second ink supply section. The first mode is a mode for ejecting the first ink by an ejection capability which is equal to or less than the supply capability of the first ink supply section and which is greater than a supply capability of the second ink supply section.

According to the printing method of the application example, in accordance with for example the type of the medium, the type of the ink to be ejected may be changed, or the control to eject the first ink may be different from the control to eject the second ink when both types of inks are ejected. In this case, the supply capability of the first ink supply section is high, and the first ink is continuously ejected. Therefore, it is possible to perform printing at a high speed.

In addition, the invention can be realized in various forms such as a printing method and a printing apparatus, a print control method and a print control apparatus, a computer program for implementing functions of such a method or apparatus, a recording medium in which the computer program is recorded, and a data signal which includes the computer program and is incorporated in a carrier wave.

BRIEF DESCRIPTION OF THE DRAWINGS

The invention will be described with reference to the accompanying drawings, wherein like numbers reference like elements.

FIG. 8 is an explanatory diagram illustrating a feeding method of a printing head during printing in a first mode.

FIG. 9 is an explanatory diagram illustrating a feeding method of the printing head during printing in a second mode.

DESCRIPTION OF EXEMPLARY EMBODIMENTS

Hereinafter, an embodiment of the invention will be described with reference to the accompanying drawings. It should be noted that, in the following drawings, the dimensions of respective members and the like are determined such that the members and the like are recognizable, and thus may not exactly reflect those in actual situations.

Embodiment

Embodiment of the Invention

Next, the embodiment of the invention will be described in order of the following items: A. Structure of Apparatus; B. Structure of Printing Head Unit; C. Feeding Method; D. Main Scanning Range; E. Ejection Capability and Supply Capability in Each Mode; F. Execution of Printing; and G. Modification Examples.

A. Structure of Apparatus

Figure 1:
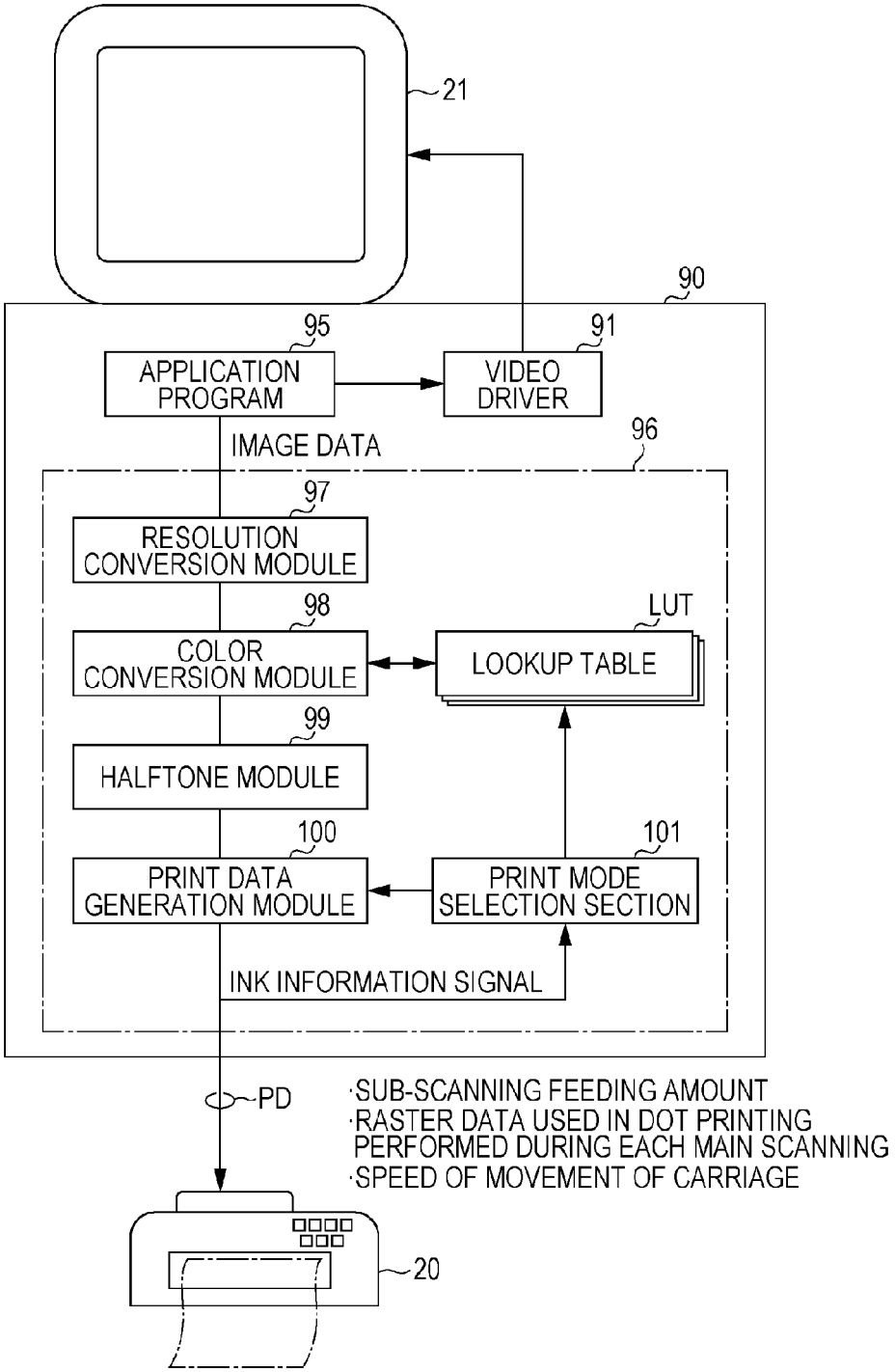
FIG. 1 is an explanatory diagram illustrating a configuration of a printing system as one example of the invention.

FIG. 1 is a block diagram illustrating a structure of a printing system as one example of the invention. This printing system includes a computer 90 as a print control apparatus and a printer 20 as a printing section. The combination of the printer 20 and the computer 90 can be called a "printing apparatus" in the broad sense.

The computer 90 includes an application program 95 running on a predetermined operating system. A video driver 91 and a printer driver 96 are incorporated in the operating system, and the application program 95 outputs print data PD to be transferred to the printer 20 through these drivers. The application program 95 performs desired processing on a processing target image, and displays a resulting image on a CRT 21 through the video driver 91.

When the application program 95 issues a print command, the printer driver 96 in the computer 90 receives image data from the application program 95, and then converts the image data into print data PD to be supplied to the printer 20. In the example shown in FIG. 1, the printer driver 96 includes a resolution conversion module 97, a color conversion module 98 as a color conversion section, a halftone module 99, a print data generation module 100, a printing mode selection section 101, and a plurality of lookup tables LUT. The plurality of lookup tables LUT are provided to correspond to a plurality of color ink printing modes which can be selected by the printing mode selection section 101.

The printing mode selection section 101 holds information on the types of available printing papers P. In addition, the printing mode selection section 101 is able to allow a user to select an appropriate type among the available printing papers P. Specific examples of the types of the available printing papers P include a plain paper, a glossy paper, and the like. The printing mode selection section 101 holds information on inks which are necessary for modes corresponding to the types of the printing papers P.

The resolution conversion module 97 has a function of converting the resolution (that is, the number of pixels per unit length) of color image data, which is used for the application program 95, into the resolution which can be used for the printer driver 96. The image data, which is subjected to the resolution conversion in such a manner, is still image information of three colors of RGB. The color conversion module 98 selects a lookup table LUT corresponding to the selected color ink printing mode among the plurality of lookup tables LUT, and converts the RGB image data into multi-tone data (for example, CMYK data) of a plurality of ink colors, which can be used in the printer 20, for each pixel with reference to the selected lookup table LUT.

The multi-tone data, which is subjected to the color conversion, has, for example, a tone value of 256 levels. The halftone module 99 executes halftone processing to express the tone value on the printer 20 by distributing and forming ink dots. The image data, which is subjected to the halftone processing, can be realigned in the data sequence to be sent to the printer 20 by print data generation module 100, and is finally output as print data PD. It should be noted that the print data PD includes raster data indicating a dot printing state during each main scanning, data indicating the sub-scanning feeding amount, and data indicating the speed of movement of a carriage 30.

In addition, the printer driver 96 may be a program for realizing a function that generates the print data PD. A program for realizing the functions of the printer driver 96 is supplied in a format recorded on a computer-readable recording medium. As this kind of the recording medium, various computer readable recording media can be used, including flexible disks, CD-ROMs, magnetooptical discs, IC cards, ROM cartridges, punch cards, printed items on which a code such as a bar code is printed, a computer internal storage device (a memory such as RAM or ROM), an external storage device, and the like.

Figure 2:
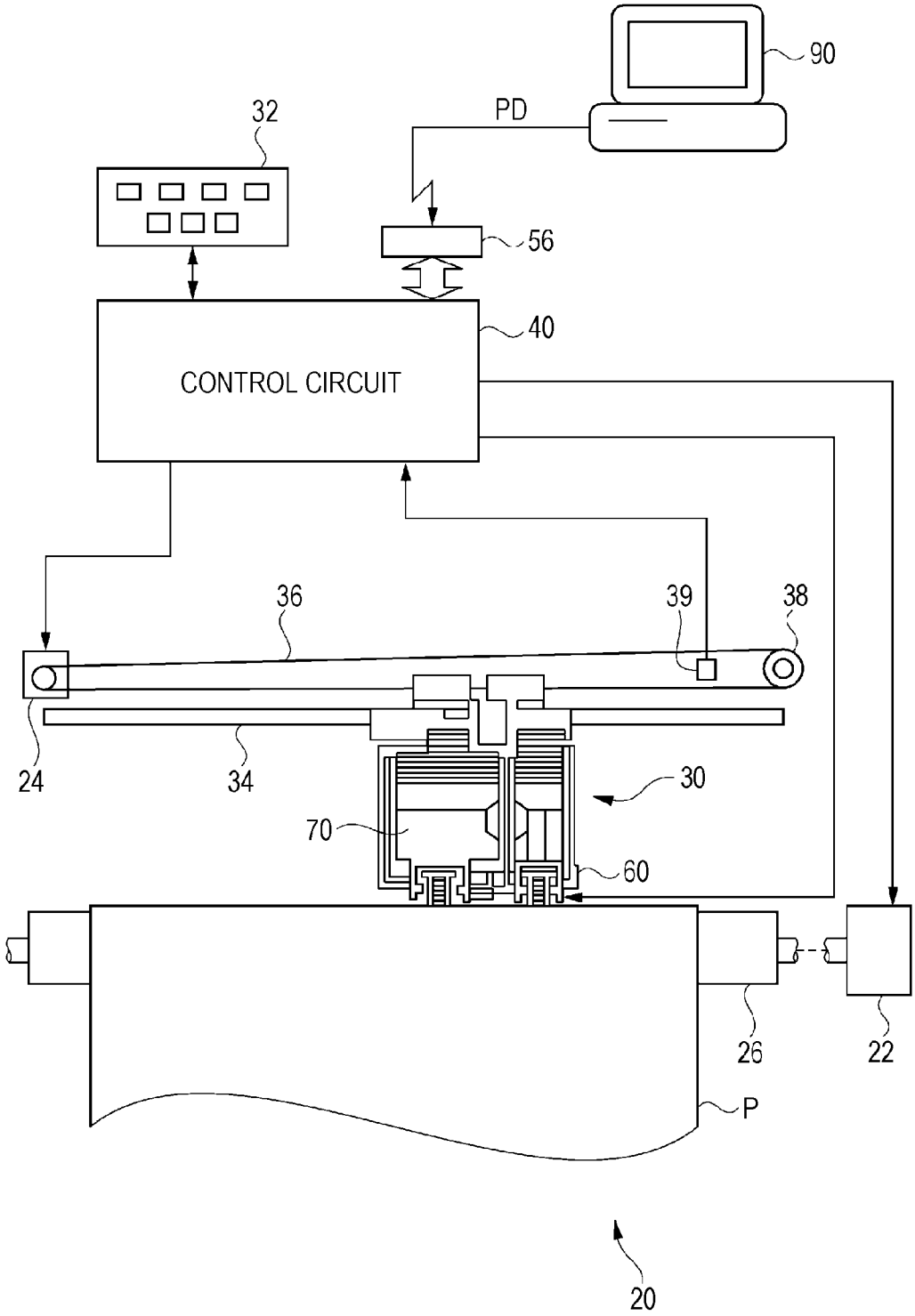
FIG. 2 is an explanatory diagram illustrating a configuration of a printer.

FIG. 2 is a schematic structural diagram of the printer 20. The printer 20 includes: a sub-scanning feeding mechanism that transports the printing paper P in the sub-scanning direction SS using a paper feeding motor 22, a main scanning feeding mechanism that moves the carriage 30 back and forth in the axial direction (main scanning direction MS) of a platen 26 using a carriage motor 24, a head driving mechanism that drives a printing head unit 60 built into the carriage 30 and controls ink ejection and dot formation, and a control circuit 40 that controls interaction between the signals of the paper feeding motor 22, the carriage motor 24, the printing head unit 60, and an operation panel 32. The control circuit 40 is connected to the computer 90 through a connector 56.

The sub-scanning feeding mechanism, which transports the printing paper P, includes a gear train (not shown) that transfers rotation of the paper feeding motor 22 to the platen 26 and a paper transporting roller (not shown). Further, the main scanning feeding mechanism, which moves the carriage 30 back and forth, includes a sliding shaft 34 that is provided in parallel with the axis of the platen 26 and that slidably supports the carriage 30, a pulley 38 on which an endless driving belt 36 is stretched between itself and the carriage motor 24, and a position sensor 39 that detects the starting position of the carriage 30.

The acquisition section, the scanning section, the moving section, and the control section described in claims respectively correspond to the connector 56, the carriage motor 24, the paper feeding motor 22, and the control circuit 40. Further, the nozzle array direction in claims is defined to include the sub-scanning direction SS.

Figure 3:
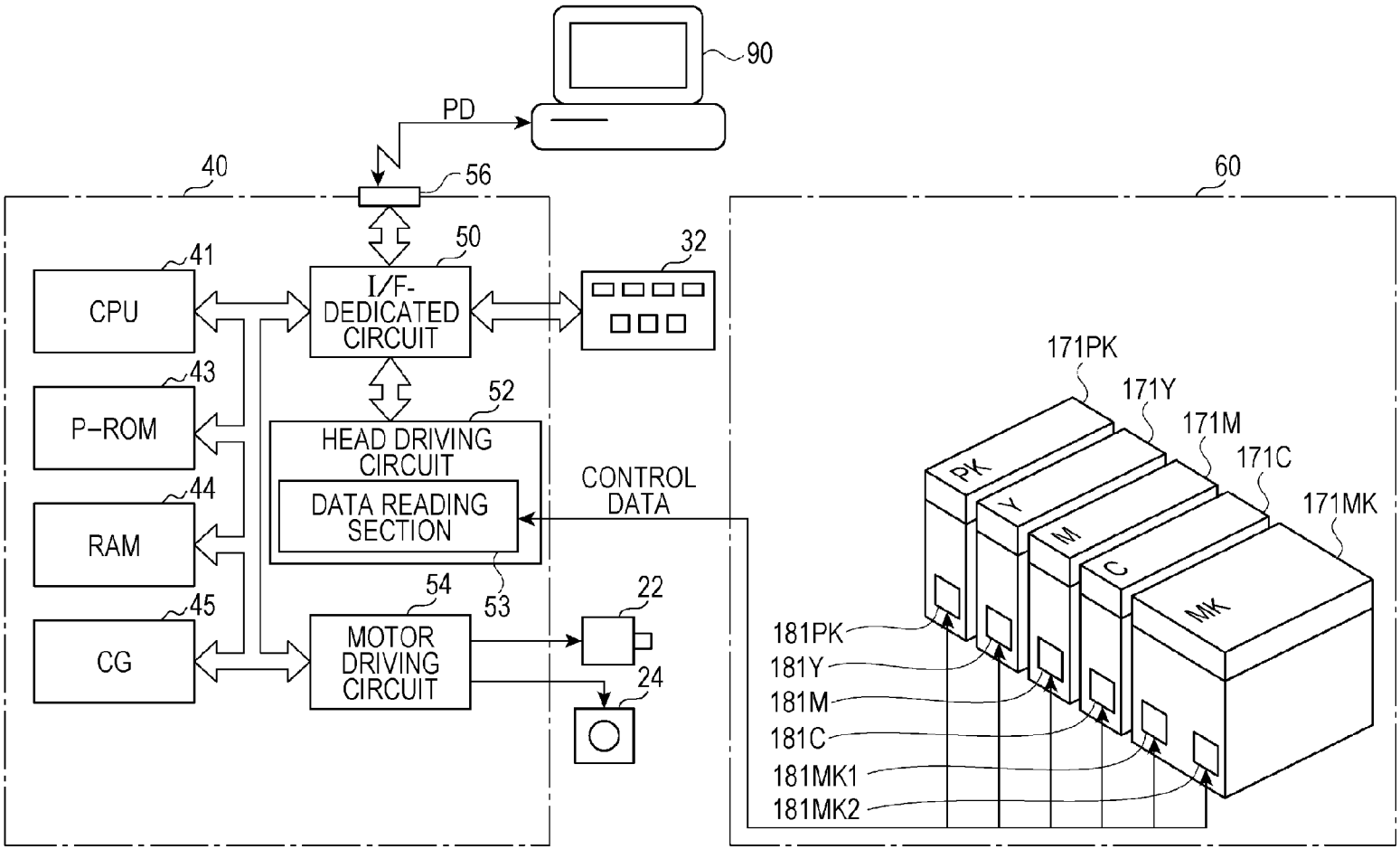
FIG. 3 is an explanatory diagram illustrating a configuration of a control circuit in the printer.

FIG. 3 is a block diagram illustrating a structure of the printer 20 focused on a control circuit 40. The control circuit 40 is formed as an arithmetic-logic circuit including a CPU 41, a programmable ROM (PROM) 43, a RAM 44, and a character generator (CG) 45 storing dot matrices for characters. The control circuit 40 further includes an I/F-dedicated circuit 50 that functions as only an interface with the external motors and the like, a head driving circuit 52 that is connected to the I/F-dedicated circuit 50 and ejects the ink by driving the printing head unit 60, and a motor driving circuit 54 that drives the paper feeding motor 22 and the carriage motor 24. The head driving circuit 52 includes a data reading section 53.

The I/F-dedicated circuit 50 contains a parallel interface circuit and is capable of receiving the print data PD supplied from the computer 90 through the connector 56. The printer 20 prints images on the basis of the print data PD. In addition, the RAM 44 functions as a buffer memory for the temporary storage of raster data.

B. Structure of Printing Head Unit

Figure 4:
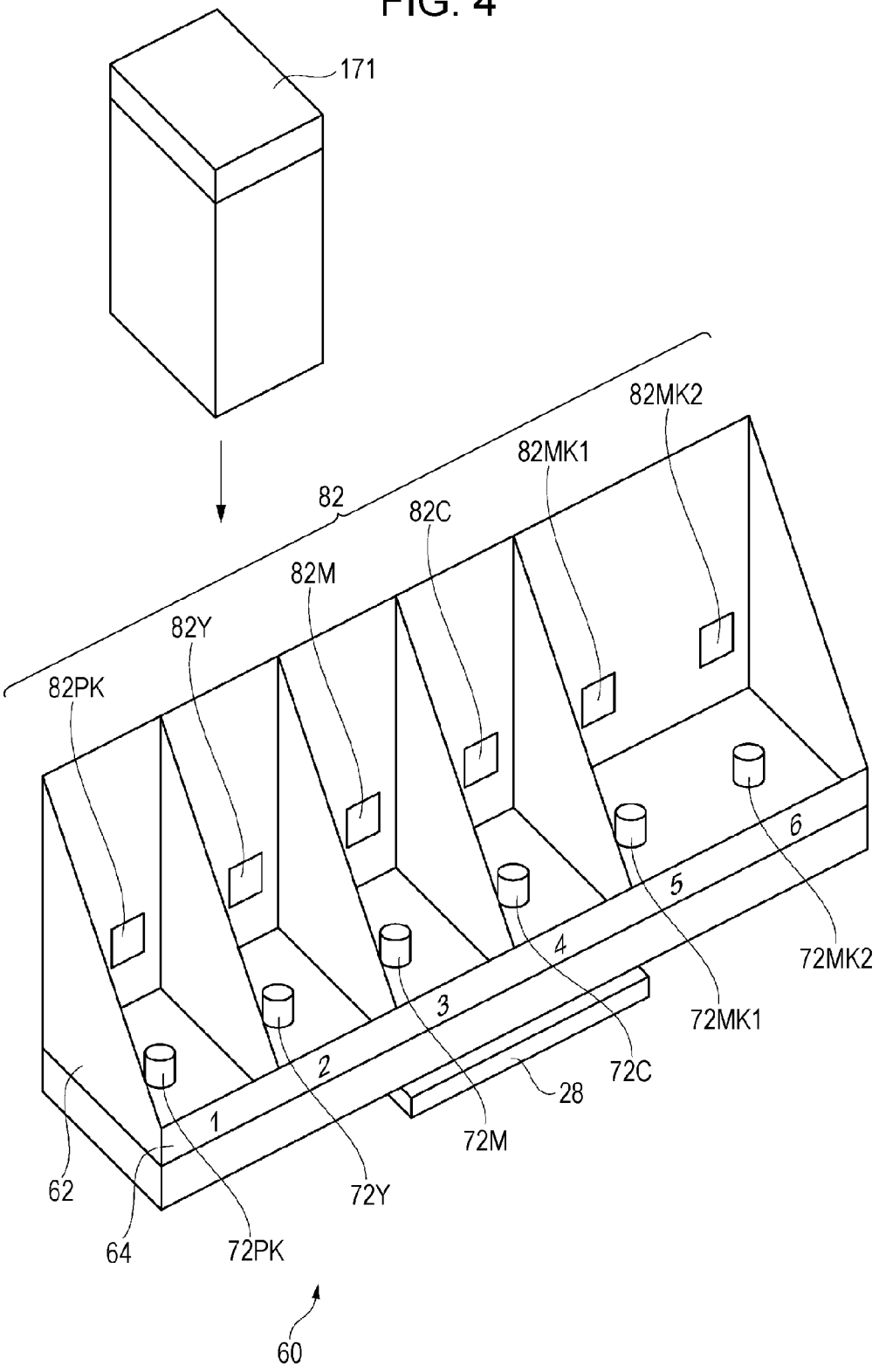
FIG. 4 is a perspective view of a printing head unit.

FIG. 4 is a perspective view of the printing head unit 60. The printing head unit 60 includes an ink cartridge mount section 62 and a printing head 28. In the ink cartridge mount section 62, as shown in FIG. 3, the following cartridges can be mounted: a black dye ink cartridge 171PK that contains a black dye ink PK; a yellow ink cartridge 171Y that contains a yellow ink Y; a magenta ink cartridge 171M that contains a magenta ink M; a cyan ink cartridge 171C that contains a cyan ink C; a black pigment ink cartridge 171MK that contains a black pigment ink MK. Further, the black pigment ink cartridge 171MK is formed of a casing of which the size is twice the size of another cartridge. In this example, three inks of the yellow ink Y, the cyan ink C, and the magenta ink M are used as color inks Furthermore, by using four inks of the three color inks (Y, C, and M) and the black pigment ink MK, it is possible to perform color printing and monochrome printing. Further, by using four inks of the three color inks (Y, C, and M) and the black dye ink PK, it is also possible to perform color printing and monochrome printing.

In such ink cartridges, memories 181PK, 181Y, 181M, 181C, 181MK1, and 181MK2 are respectively provided as memories for the ink information. Each memory stores ink information for specifying the type of ink contained in the ink cartridge. The ink information is read by a data reading section 53 (FIG. 3) through six memory reading sections 82PK, 82Y, 82M, 82C, 82MK1, and 82MK2 which are provided in the ink cartridge mount section 62, and is sent as an ink information signal to the computer 90 through the I/F-dedicated circuit 50 and the connector 56. The computer 90 is able to determine whether or not ink cartridges are mounted in the ink cartridge mount section 62 on the basis of the ink information signal. Further, a label 64 for indicating the mounting locations of the ink cartridges is provided for the ink cartridge mount section 62. In addition, the size of the casing of the black pigment ink cartridge 171MK is twice the size of another cartridge, and thus two memories and two memory reading sections are provided for the cartridge.

In the ink cartridge mount section 62, six injection pipes 72PK, 72Y, 72M, 72C, 72MK1, and 72MK2 are provided to be erect, and the pipes are inserted into the respective ink cartridges so as to form ink flow passages. The injection pipes are connected to the respective nozzle groups within the printing head 28 which is provided on the lower part of the printing head unit 60. The supply capability of each of the six injection pipes is the same. Further, in the black pigment ink cartridge 171MK, two injection pipes 72MK1 and 72MK2 are provided to be erect. Thus, compared with the injection pipe of another cartridge, the injection pipes for the black pigment ink cartridge 171MK have a high supply capability. Further, in the embodiment, the black pigment ink cartridge 171MK, which is formed as a single ink cartridge 171 corresponding to two ink cartridges 171, is employed. Thereby, the black pigment ink MK is supplied to the two injection pipes 72MK1 and 72MK2. Hence, compared with a case of supplying the ink by the two black pigment ink cartridges 171MK, it is possible to prevent the amount of remaining ink from being not uniform. As a result, it is possible to solve the problem of non-uniformity in the amount of remaining ink. The printing head 28 will be described later in detail.

In the printer 20 having the above-mentioned hardware structure, while the printing paper P is transported by the paper feeding motor 22, the carriage 30 is moved back and forth by the carriage motor 24, the printing head 28 is driven, droplets of the respective color inks are ejected, and the ink dots are formed, thereby forming a multi-color multi-tone image on the printing paper P.

Figure 5:
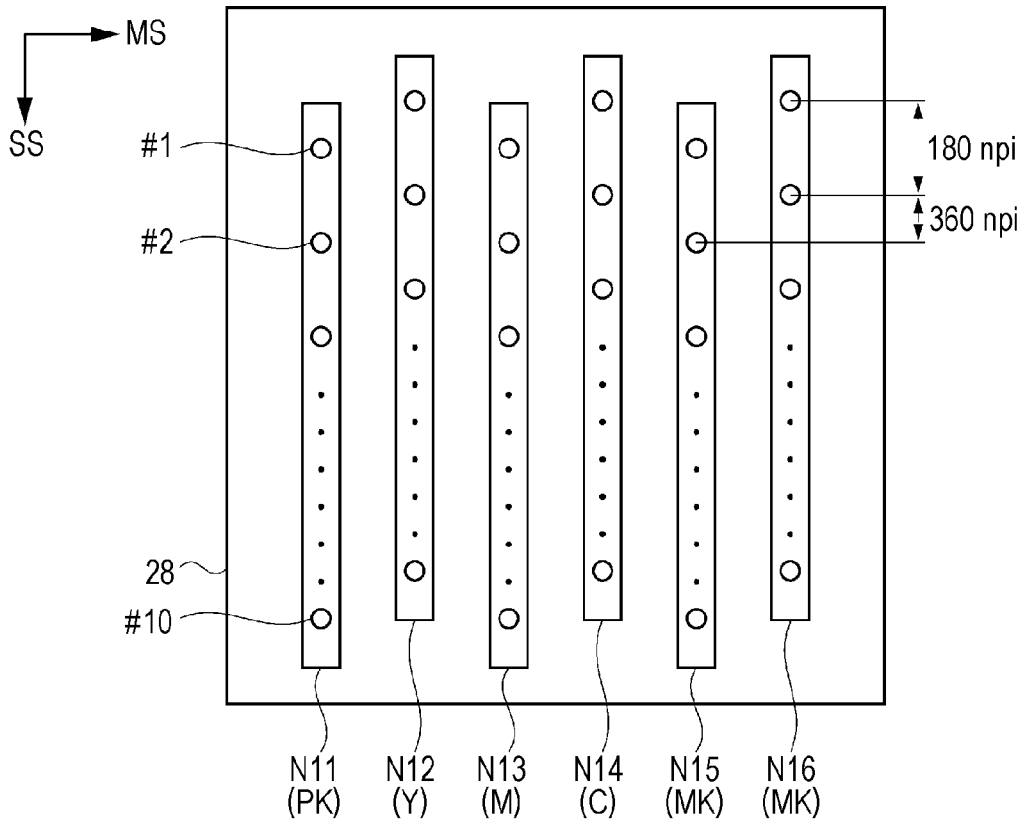
FIG. 5 is an explanatory diagram illustrating a nozzle array on a lower surface of a printing head.

FIG. 5 is an explanatory diagram illustrating nozzle arrays on the lower surface of the printing head 28. Six nozzle groups N11 to N16 are provided on the lower surface of the printing head 28. A plurality of nozzles Nz, which constitutes each nozzle group, is aligned along the sub-scanning direction SS. Ten nozzles, which constitute each nozzle group, are provided with a uniform pitch, and the ten nozzles eject ink droplets of the same color. In the example of FIG. 5, the plurality of nozzles Nz of the single nozzle group is arranged in a straight line along the sub-scanning direction SS, but may be arranged in a staggered manner.

The six nozzle groups N11 to N16 are respectively connected to the injection pipes 72PK, 72Y, 72M, 72C, 72MK1, and 72MK2. The black dye ink PK is ejected from the nozzle group N11, the yellow ink Y is ejected from the nozzle group N12, the magenta ink M is ejected from the nozzle group N13, the cyan ink C is ejected from the nozzle group N14, and the black pigment ink MK is ejected from the nozzle groups N15 and N16. Each nozzle group is constituted of nozzles arranged with a uniform pitch of 180 npi in the sub-scanning direction SS, and each nozzle group is able to form dots on the printing medium, at a concentration of maximum 180 dpi in the sub-scanning direction SS, through a single main scanning operation.

In addition, the nozzle groups N11, N13, and N15 are shifted by 360 npi in the sub-scanning direction SS, relative to the nozzle groups N12, N14, and N16. Hence, when using the nozzle groups N15 and N16 simultaneously in the single main scanning operation, it is possible to form dots of the black pigment ink MK on the printing medium at a concentration of 360 dpi in the sub-scanning direction SS. In addition, the ink is not ejected at the same position in the single main scanning operation between the nozzle groups N15 and N16. Further, the flow passages of the black pigment ink MK are separated from each other between the injection pipes 72MK1 and 72MK2 and between the nozzle groups N15 and N16, but the flow passages are connected in the black pigment ink cartridge 171MK as described above. The structures of the flow passages of other inks are formed to be the same, whereby it is possible to easily manufacture the printing head 28.

In each nozzle, a piezoelectric element, which is a single electrostrictive element and is excellent in response, is disposed. The piezoelectric element is provided at a position adjacent to the ink passage which guides the ink to the nozzle. The piezoelectric element is an element that converts electric energy into mechanical energy at an extremely high speed by the crystal structure being twisted through application of a voltage as is well known. In this example, by applying a voltage with a predetermined time interval between the electrodes which are provided at both ends of the piezoelectric element, the piezoelectric element elongates in accordance with the application time of the voltage, and deforms one side wall of the ink passage. As a result, the volume of the ink passage is reduced in accordance with the elongation of the piezoelectric element, and the ink corresponding to the reduced volume is ejected as liquid droplets from the tip of the nozzle at a high speed. The ink droplets form dots on the printing paper P, thereby performing printing.

The head, the ink supply sections, and the nozzle arrays in claims respectively correspond to the printing head 28, the injection pipes 72, and the nozzle groups.

Figures 6, 7:
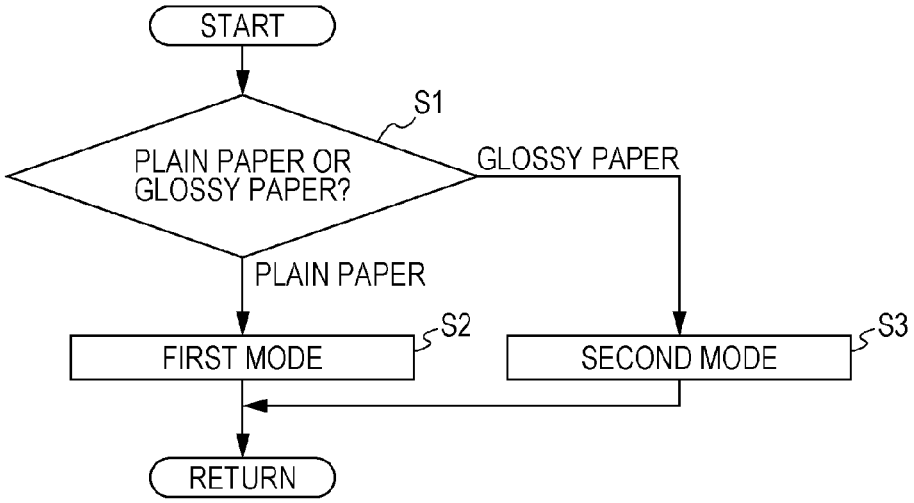
FIG. 6 is a flowchart illustrating a procedure of selecting a mode.
FIG. 7 is a table illustrating differences of modes.

FIG. 6 is a flowchart illustrating a procedure of selecting a mode in the printer driver 96. FIG. 7 is a table illustrating differences of modes. In step S1 of FIG. 6, the printing mode selection section 101 specifies whether the type of the printing paper P is a plain paper or a glossy paper. If the type of the printing paper P is the plain paper, the print data PD for performing printing in the first mode is output (step S2). If the type of the printing paper P is the glossy paper, the print data PD for performing printing in the second mode is output (step S3).

That is, the color conversion module 98 selects a lookup table LUT, which corresponds to the specified type of the printing paper P, among the plurality of provided lookup tables LUT, and converts RGB image data into multi-tone data corresponding to the amounts of the inks with reference to the lookup table LUT. At this time, if the type of the printing paper P is the plain paper, the multi-tone data is generated such that the black pigment ink MK is ejected (first mode). If the type of the printing paper P is the glossy paper, the multi-tone data is generated such that the black dye ink PK is ejected (second mode). Further, when printing is performed in the first mode, the data indicating the sub-scanning feeding amount can be associated with information for performing printing through the band feeding. When printing is performed in the second mode, the data indicating the sub-scanning feeding amount can be associated with information for performing printing through the interlaced feeding. The band feeding and the interlaced feeding will be described later in detail.

Further, in the example, the speed of movement of the carriage 30 is also set to be different in accordance with whether printing is performed in the first mode or printing is performed in the second mode. That is, when printing is performed in the first mode, the carriage 30 ejects the ink while moving at a high speed. When printing is performed in the second mode, the carriage 30 ejects the ink while moving at a low speed. It should be noted that the level of the movement speed of the carriage 30 indicates a relative relationship between the first mode and the second mode when the modes are compared with each other. As the movement speed of the carriage 30 is lower, it is possible to further reduce a possibility that there may be misalignment in the positions of the ejected ink droplets landed on the printing paper P. Therefore, it can be said that it is possible to perform printing with high quality. Accordingly, when performing printing in the first mode, it is possible to perform printing at a high speed. In addition, when performing printing in the second mode, it is possible to perform printing with high quality.

C. Feeding Method

C-1. Feeding Method in First Mode; "Band Feeding"

FIG. 8 is an explanatory diagram illustrating a feeding method of the printing head 28 during the printing in the first mode. In the first mode, in the forward pass of the main scanning, printing is performed using the nozzle groups N12, N13, and N14 corresponding to the color inks and the nozzle groups N15 and N16 corresponding to the black pigment ink MK. However, in the backward pass, the nozzle groups N15 and N16 are not used but only the nozzle groups N12, N13, and N14 are used. It should be noted that each nozzle ejects or does not eject the ink droplets during the main scanning on the basis of the print data PD, but "the nozzle groups are not used" described herein means that the nozzles are never used (in the backward pass) during printing of the first page of the printing medium P. The other cases are included in the case where "nozzles are used". Further, the nozzle groups N12, N13, and N14 corresponding to the color inks are configured, as described above, such that the nozzle group N13 is shifted by 360 npi in the sub-scanning direction SS, relative to the nozzle groups N12 and N14. However, for convenience of description, it is assumed that none of the nozzle groups N12, N13, and N14 corresponding to the color inks is misaligned in the sub-scanning direction SS.

In the first mode, printing is performed at 360 dpi in the sub-scanning direction SS. That is, the concentration of the raster on the printing medium is 360 dpi. Here, the "raster" is a "row" that indicates a dot formation position which is virtually defined on the printing medium (the row extends in the main scanning direction MS). Further, the spacing of the raster is equal to a half of the nozzle pitch.

In the forward pass in which the nozzle groups N12, N13, and N14 corresponding to the color inks and the nozzle groups N15 and N16 corresponding to the black pigment ink MK are used, dots of the black pigment can be formed on all the rasters at 360 dpi. However, dots of cyan, magenta, and yellow can be formed on only the every other raster at 180 dpi. For example, as shown in the upper left side of FIG. 8, in the pass 1 (forward pass), dots of the black pigment can be formed on the rasters of 1 to 20. However, dots of cyan, magenta, and yellow can be formed on only the every other raster of 1, 3, 5, . . . , and 19. Here, the "pass number" is counted as follows: 1st pass as the first forward pass of the main scanning; 2nd pass as the backward pass; 3rd pass as the next forward pass; and so on. Further, the numbers, which are written in the cells on the left side of FIG. 8, are numbers of the nozzles used to print the rasters. It should be noted that the number of each nozzle is #1, #2, . . . in an order from the upstream side in the sub-scanning direction SS, as shown in FIG. 5.

When the forward pass of the main scanning ends, the control circuit 40 moves the printing head 28 in the sub-scanning direction SS by an amount of a single raster corresponding to a half of the nozzle pitch. Then, the backward pass (2nd pass) of the main scanning is performed. In the first mode, the nozzle groups N15 and N16 are not used in the backward pass, and only the nozzle groups N12, N13, and N14 are used. Accordingly, the cyan, magenta, and yellow inks are printed on every other raster in the forward pass, and dots of cyan, magenta, and yellow are formed on the rasters, which are vacant between the printed rasters, in the backward pass. For example, as shown in the upper right side of FIG. 8, in the 2nd pass (backward pass), dots of cyan, magenta, and yellow are formed on the every other raster of 2, 4, 6, . . . , and 20. As a result, dots of cyan, magenta, and yellow are formed on all the rasters 1 to 20. That is, all the rasters 1 to 20 can be filled with the dots of cyan, magenta, and yellow through two passes of the forward pass and the backward pass. In contrast, all the rasters 1 to 20 can be filled with the dots of the black pigment through only the forward pass (single pass). Hence, assuming that the two rasters formed by two passes of the forward pass and the backward pass are a unit area, the number of the main scanning operations of the nozzle groups N15 and N16 is different from the number of the main scanning operations of the nozzle groups N12, N13, and N14. Therefore, it can be said that the ejection control operations are different.

When the forward pass and the backward pass of the main scanning ends, the control circuit 40 moves the printing head 28 in the sub-scanning direction SS by an amount of 19 rasters such that the first nozzle #1 forms dots on the 21st raster. Then, the forward pass of the main scanning (3rd pass) is performed again. In the first forward pass and backward pass of the main scanning, all the rasters 1 to 20 are printed. Thus, in the next forward pass and backward pass, the rasters 21 to 40 are printed. Hereinafter, in a similar manner, 20 continuous rasters corresponding to the sum of the nozzles of the nozzle groups N15 and N16 are printed through the single back-and-forth motion of the main scanning.

FIG. 8 shows whether each raster is printed through the forward pass or is printed through the backward pass, and what nozzle numbers of each nozzle array perform the printing, on the right side of the drawing. In the right side table of FIG. 8, the raster, which is indicated by "forward" in the cell, is printed in the forward pass, and the raster, which is indicated by "backward" in the cell, is printed in the backward pass. In addition, the numbers, which are written on the side of "forward" or "backward", indicates what nozzle numbers of each nozzle array perform the printing. It can be seen from FIG. 8 that, in a case of using the color inks (cyan, magenta, and yellow), the rasters printed in the forward pass and the rasters printed in the backward pass are alternately repeated. In contrast, in a case of using the black pigment ink, all the rasters are printed in the forward pass. Hence, there may be no misalignment of dots of the black pigment ink caused by bidirectional printing, and a straight line can be exactly drawn for example even in a case where the straight line is drawn along the sub-scanning direction SS.

In addition, in the feeding method, in both cases of using the color inks (cyan, magenta, and yellow) and the black pigment ink, all the 20 continuous rasters are printed, and subsequently the next 20 continuous rasters are printed. Such a "method of printing a bundle of continuous rasters, subsequently moving the printing head 28 by an amount of the number of rasters included in the bundle, printing a next bundle of rasters, and repeating this process" is hereinafter referred to as the "band feeding".

In contrast, the "interlaced feeding" can be applied to the case where dots of the color inks (cyan, magenta, and yellow) are printed on every other rasters in a single pass. Here, the "interlaced feeding" is defined as a "method of filling spacing rasters between the printed rasters without printing the entire bundle of the continuous rasters and newly printing dots on every other (or every n-th) raster in a new printing region".

Then, in the second mode of performing printing using the black dye ink PK instead of the black pigment ink MK, printing is performed through the "interlaced feeding". Next, the feeding method of the "interlaced feeding" will be described.

C-2. Feeding Method in Second Mode; "Interlaced Feeding"

FIG. 9 is an explanatory diagram illustrating a feeding method of the printing head 28 during the printing in the second mode. In the feeding method, the control circuit 40 performs the sub-scanning feeding by an amount of 9 rasters before the forward pass of the main scanning ends and the backward pass is performed, and performs the sub-scanning feeding by an amount of 11 rasters before the backward pass of the main scanning ends and the next forward pass is performed. The other points are the same as those of the description in the feeding method in the first mode; "band feeding".

As shown in FIG. 9, in the feeding method, in a case of using the black dye ink and the color inks, the rasters 1, 3, 5, . . . , and 19 are printed in the 1st pass (forward pass), and the rasters 10, 12, 14, . . . , and 28 are printed in the 2nd pass (backward pass). The rasters 10, 12, 14, 16, 18, and 20 are printed to fill the gaps between the printed rasters 9, 11, 13, 15, 17, and 19. Then, the rasters 22, 24, 26, and 28 are newly printed with intervals of single rasters. The spacing rasters 21, 23, 25, 27, and 29 between the rasters 22, 24, 26, and 28 are printed in 3rd pass (forward pass). In addition, the raster 20 printed in the 2nd pass (backward pass), the raster 29 printed in the 3rd pass (forward pass), and the like are positioned at the ends of the printed rasters. Hence, in the strict sense, it is difficult to say that these rasters are "spacing rasters", or "inter-rasters". However, for convenience of description, the rasters are collectively referred to as "spacing rasters" or "inter-rasters". Hereinafter, the "rasters positioned at the ends" are not separately described.

In a similar manner to FIG. 8, FIG. 9 shows whether each raster is printed through the forward pass or is printed through the backward pass, and what nozzle numbers of each nozzle array perform the printing, on the right side of the drawing. It can be seen from FIG. 9 that, in a case of using the color inks (cyan, magenta, and yellow), the rasters printed in the forward pass and the rasters printed in the backward pass are alternately repeated. In the case of performing the band feeding, breaks may occur between bundles of the rasters which are continuously printed through minor operations of the sub-scanning feeding. However, in the feeding method using the second mode, the interlaced feeding is performed, and thus the above-mentioned problem does not arise. In addition, as described above, assuming that two rasters are set as a unit area, the numbers of main scanning operations are different between the nozzle group N11 and the nozzle groups N15 and N16. Therefore, it can be said that the ejection control operations are different. Further, it can be said that the ejection control of the nozzle group N11 is the same as the ejection control of the nozzle groups N12, N13, and N14.

As described above, according to the printer 20, it is possible to select an appropriate feeding method in accordance with the type of the printing paper P. In addition, the plain paper is generally used in text printing, where text is usually black. Hence, the first mode for performing printing using the black pigment ink, which is less likely to cause running, is selected. The glossy paper is generally used in photo printing, where the color tone and the color continuity are important. Hence, the second mode for performing printing using the black dye ink, which is less likely to cause blobbing in glossiness, is selected. Accordingly, it is possible to perform printing with high quality regardless of the types of the printing papers P such as the plain paper and the glossy paper.

Furthermore, according to the first mode, it is possible to form dots on each raster by using the color inks after forming dots on each raster by using the black pigment ink MK. Therefore, similarly to the case where dots are formed using the black pigment ink MK after dots are formed using the color dye ink, the pigment ink permeates into and spreads in the components of the color dye ink, and thus it is possible to reduce deterioration in the color developing property of the black pigment ink. Accordingly, it is possible to perform printing with high quality.

D. Main Scanning Range

D-1. Main Scanning Range in First Mode

Figure 10:
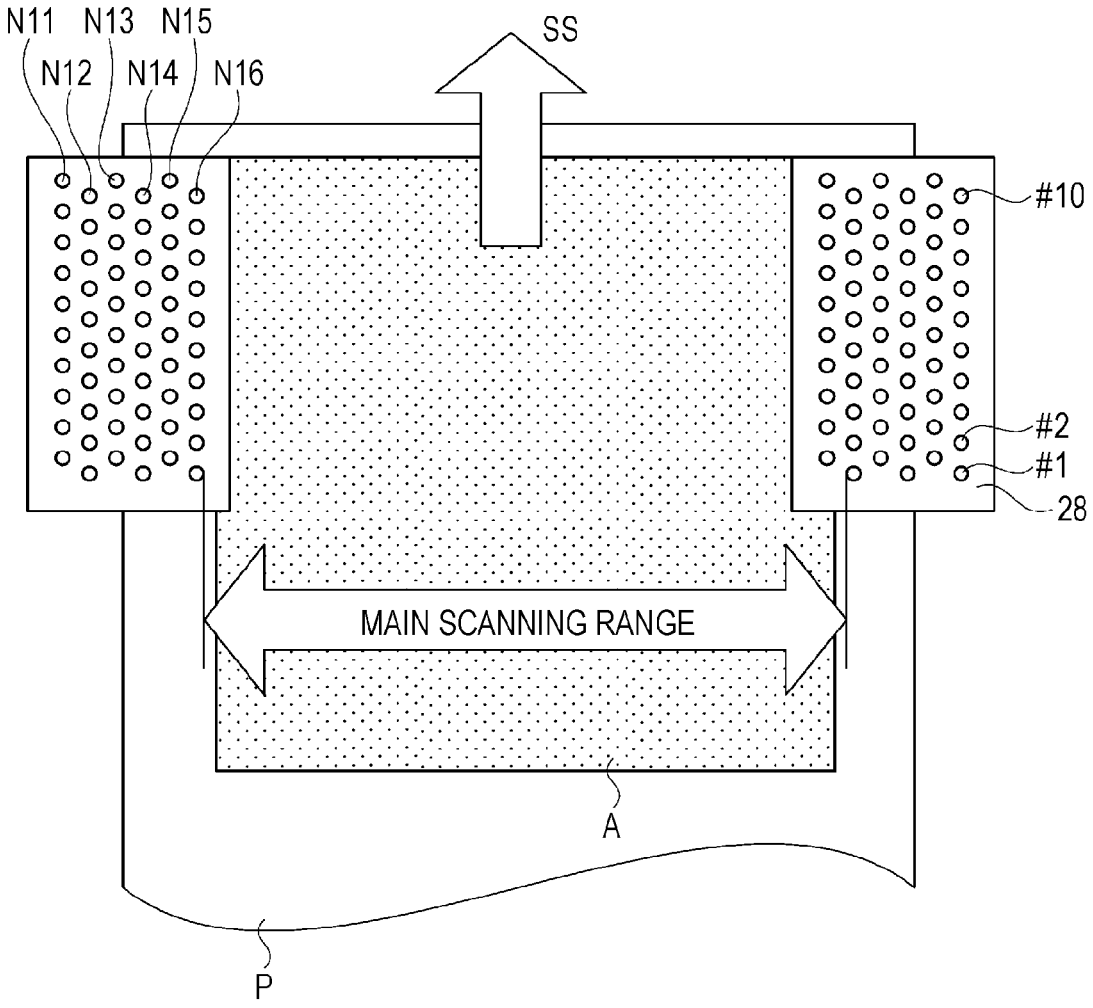
FIG. 10 is an explanatory diagram illustrating a main scanning range of the printing head during printing in the first mode.

FIG. 10 is an explanatory diagram illustrating the main scanning range of the printing head 28 during printing in the first mode. FIG. 10 shows a perspective diagram of the printing head 28 viewed from the upper surface.

The range A, which is indicted as a dotted area in FIG. 10, is a range in which printing is performed on the basis of the print data.

When the first mode is selected, the carriage 30 performs the main scanning such that the ink is ejected from any one of the nozzle groups N12 to N16 into the range A in which printing is performed on the basis of the print data. Specifically, in the 1st pass (forward pass), when the carriage 30 performs the main scanning from one side to the other side in the main scanning direction MS, the main scanning is started from a position at which the nozzle group N16 is closer to the one side than the range A in the main scanning direction MS, and the main scanning is performed until reaching a position at which the nozzle group N12 is closer to the other side than the range A in the main scanning direction MS. Next, in the 2nd pass (backward pass), the main scanning is started from the position at which the nozzle group N12 is closer to the other side than the range A in the main scanning direction MS, and the main scanning is performed until reaching the position at which the nozzle group N16 is closer to the one side than the range A in the main scanning direction MS. Thereafter, the main scanning is performed by repeating the above-mentioned process. In addition, in this case, in consideration of the distance and the like necessary for increasing or reducing the speed of the carriage 30, it is possible to appropriately set a position of the nozzle group N11, which ejects the black dye ink PK, relative to the range A.

D-2. Main Scanning Range in Second Mode

Figure 11:
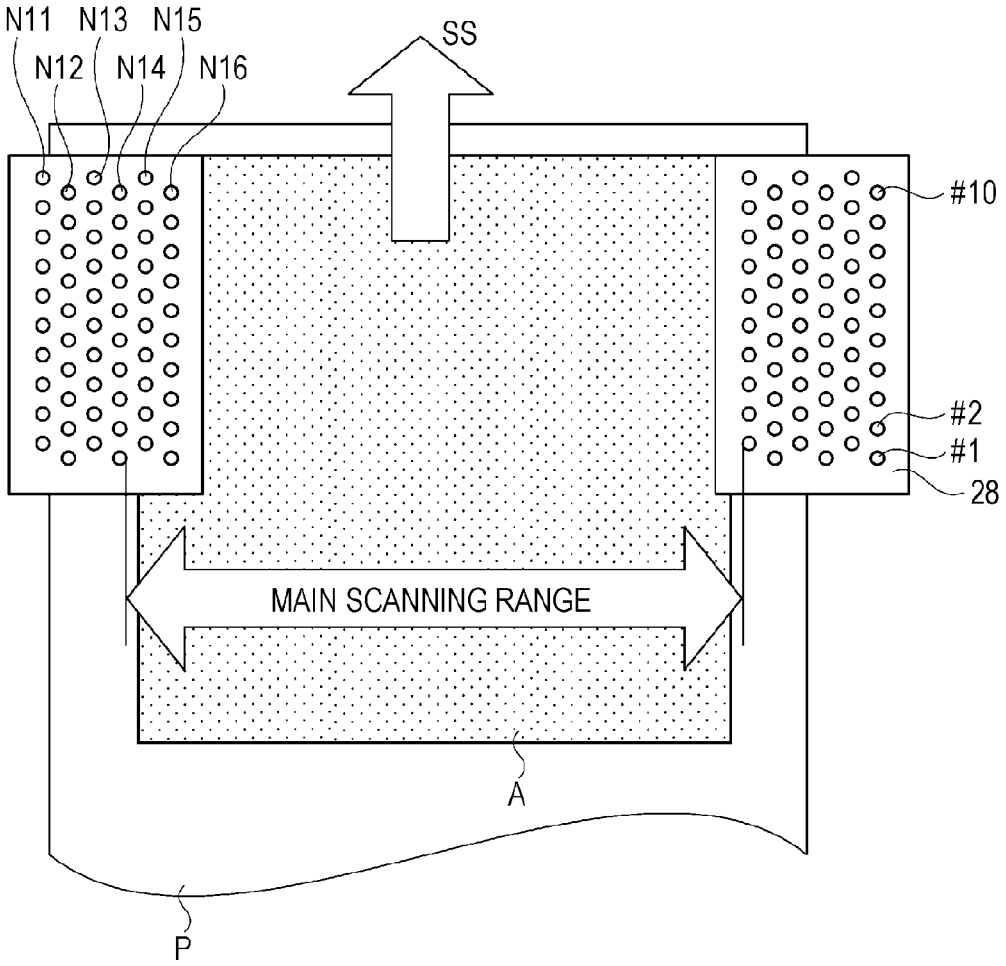
FIG. 11 is an explanatory diagram illustrating a main scanning range of the printing head during printing in the second mode.

FIG. 11 is an explanatory diagram illustrating a main scanning range of the printing head 28 during printing in the second mode. FIG. 11 shows a perspective diagram of the printing head 28 viewed from the upper surface. The range A, which is indicted as a dotted area in FIG. 11, is the same as the range in FIG. 10.

When the second mode is selected, the carriage 30 is moved such that the ink is ejected from any one of the nozzle groups N11 to N14, instead of the nozzle groups N12 to N16, into the range A in which printing is performed on the basis of the print data. Specifically, the main scanning is started from a position at which the nozzle group N14 is closer to the one side than the range A in the main scanning direction MS, and the main scanning is performed until reaching a position at which the nozzle group N11 is closer to the other side than the range A in the main scanning direction MS. Next, in the 2nd pass (backward pass), the main scanning is started from the position at which the nozzle group N11 is closer to the other side than the range A in the main scanning direction MS, and the main scanning is performed until reaching the position at which the nozzle group N14 is closer to the one side than the range A in the main scanning direction MS. Thereafter, the main scanning is performed by repeating the above-mentioned process. In addition, in this case, in consideration of the distance and the like necessary for increasing or reducing the speed of the carriage 30, it is possible to appropriately set positions of the nozzle groups N15 and N16, which eject the black pigment ink MK, relative to the range A.

In this example, the main scanning range can be changed by performing printing in the first mode or printing in the second mode. That is, in the first mode, the carriage 30 is moved in the main scanning range based on the nozzle groups N12 to N16. In contrast, in the second mode, the carriage 30 is moved in the main scanning range based on the nozzle groups N11 to N14. Accordingly, in either case, it is not necessary to move the carriage 30 in the main scanning range based on the nozzle groups N11 to N16, and thus it is possible to perform printing at a high speed.

E. Ejection Capability and Supply Capability in Each Mode

Figure 12:
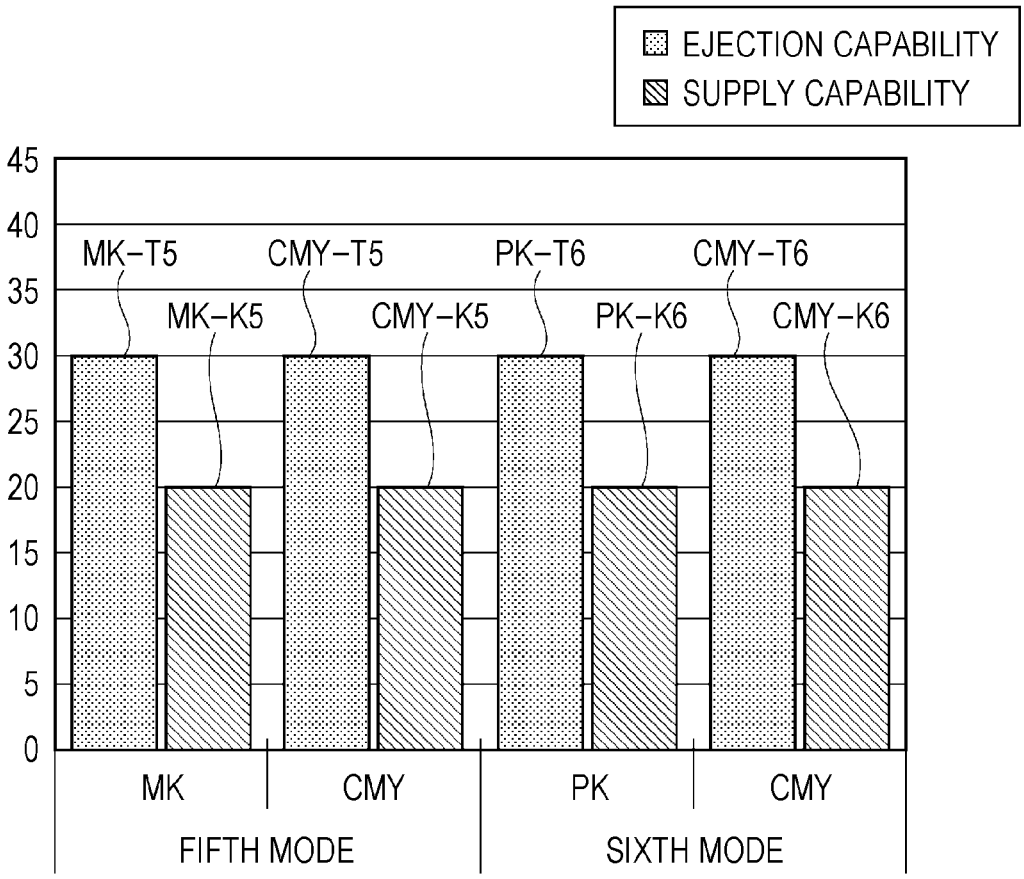
FIG. 12 is a graph illustrating ejection capabilities and supply capabilities of the printing apparatus in the modes in Comparative Example 1.
Figure 13:
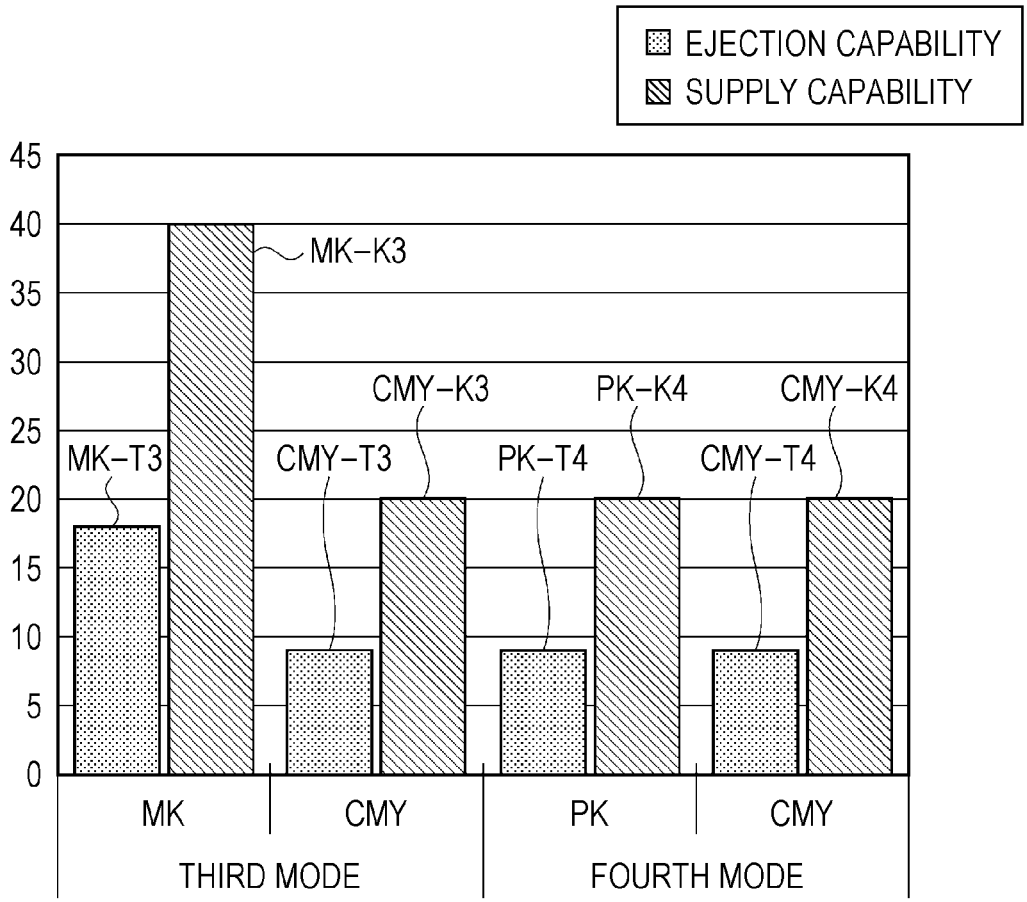
FIG. 13 is a graph illustrating ejection capabilities and supply capabilities of the printing apparatus in the modes in Comparative Example 2.
Figure 14:
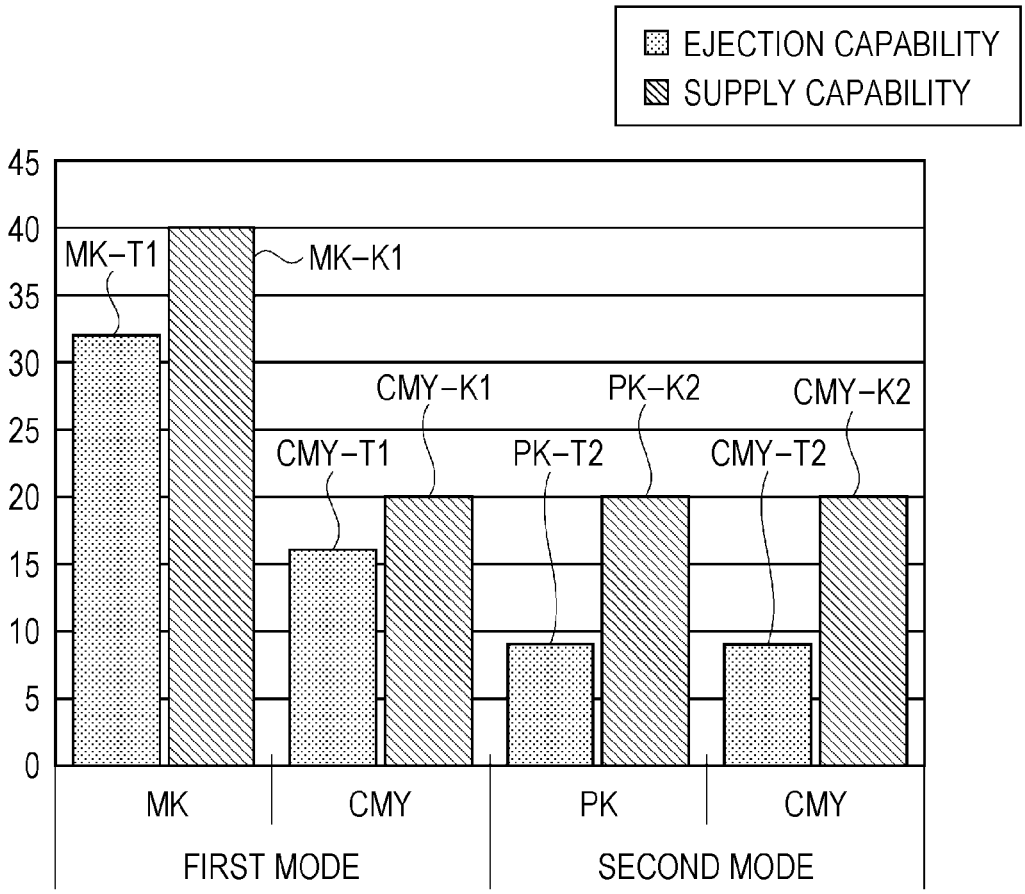
FIG. 14 is a graph illustrating ejection capabilities and supply capabilities of the printing apparatus in the modes in Comparative Example 3.

FIGS. 12, 13, and 14 are graphs respectively illustrating the ejection capabilities and the supply capabilities of the printing apparatus in the modes in Comparative Examples 1, 2, and 3. It should be noted that, in the graph, the numerical value in the vertical axis indicates a relative relationship between the ejection capability and the supply capability.

Here, as described above, the ejection capability is defined as the maximum value of the volume of the ink which can be ejected per unit time. The supply capability is defined as the maximum value of the volume of the ink which can be supplied per unit time.

The ejection capability is changed, for example, even when any one of the following factors is changed: the speed of the carriage 30 during the main scanning; the size of a single ejected ink droplet; the spacing for ink ejection; and the like. Further, the volume of the ink, which is actually ejected from the nozzle, depends on the raster data which is included in the print data PD. However, the ejection capability does not depend on the raster data which is included in the print data PD, and depends on such factors. Furthermore, at least any one of such factors is different between the different modes.

Further, the supply capability is changed even when any one of factors such as the number of the injection pipes and the magnitude of the diameter of the injection pipes is changed. Furthermore, the volume of the ink, which is supplied from the cartridge, depends on the volume of the ink which is consumed in printing. However, the supply capability does not depend on the volume of the ink which is consumed in printing, and depends on such factors. In addition, at least any one of such factors is different between the different modes.

E-1. Ejection Capability and Supply Capability Comparative Example 1

Returning to the description of FIG. 12, in Comparative Example 1, printing is performed on the basis of selection of either one of the fifth mode and the sixth mode. In the fifth mode, printing is performed using the black pigment ink MK and the color ink. In the sixth mode, printing is performed using the black dye ink PK and the color ink. In addition, a configuration of the printing apparatus, which performs printing in the fifth and sixth modes, is not limited to the above-mentioned configuration.

In FIG. 12, MK-T5, MK-K5, CMY-T5, CMY-K5, PK-T6, PK-K6, CMY-T6, and CMY-K6 respectively indicate the ejection capability for the black pigment ink MK in the fifth mode, the supply capability for the black pigment ink MK in the fifth mode, the ejection capability for the color ink in the fifth mode, the supply capability for the color ink in the fifth mode, the ejection capability for the black dye ink PK in the sixth mode, the supply capability for the black dye ink PK in the sixth mode, the ejection capability for the color ink in the sixth mode, and the supply capability for the color ink in the sixth mode.

As shown in FIG. 12, the fifth and sixth modes and the printing apparatus using such modes have the following features. 1-1. In either one mode, the ejection capability for each ink is greater than the supply capability of the printing apparatus. 1-2. In either one mode, the supply capability for each ink is the same. 1-3. In either one mode, the ejection capability for each ink is the same.

In a case where the apparatus has Feature 1-1, when a large amount of the ink is ejected on the basis of the raster data which indicates a dot printing state at the time of each main scanning included in the print data PD, the ink may be continuously ejected. In this case, the ink supply to the nozzle groups is not exactly performed at correct timing, and it is difficult to form dots on the raster through the main scanning of the carriage 30. When an excessively large amount of ink relative to the supply capability is ejected, the number of main scanning operations has to be increased on the basis of the raster data which is included in the print data PD. Further, in a case where the apparatus has Feature 1-3, such a situation may occur when either one of the black pigment ink MK and color ink is used.

However, in a case where the apparatus has Feature 1-2, the configuration of the injection pipe or the flow passage may be common to the black pigment ink MK and the color ink.

E-2. Ejection Capability and Supply Capability Comparative Example 2

FIG. 13 is a graph illustrating the ejection capabilities and the supply capabilities of the printing apparatus in the modes in Comparative Example 2. In Comparative Example 2, printing is performed on the basis of selection of either one of the third mode and the fourth mode. In the third mode, printing is performed using the black pigment ink MK and the color ink. In the fourth mode, printing is performed using the black dye ink PK and the color ink. In addition, a configuration of the printing apparatus, which performs printing in the third and fourth modes, is a configuration of the above-mentioned printer 20.

In FIG. 13, MK-T3, MK-K3, CMY-T3, CMY-K3, PK-T4, PK-K4, CMY-T4, and CMY-K4 respectively indicate the ejection capability for the black pigment ink MK in the third mode, the supply capability for the black pigment ink MK in the third mode, the ejection capability for the color ink in the third mode, the supply capability for the color ink in the third mode, the ejection capability for the black dye ink PK in the fourth mode, the supply capability for the black dye ink PK in the fourth mode, the ejection capability for the color ink in the fourth mode, and the supply capability for the color ink in the fourth mode.

As shown in FIG. 13, the third and fourth modes and the printing apparatus using such modes have the following features. 2-1. In either one mode, the supply capability of the printing apparatus for each ink is equal to or greater than the ejection capability. 2-2. The ejection capability for the black pigment ink MK (third mode) is greater than the ejection capability for the black dye ink PK (fourth mode). 2-3. The ejection capability for the black pigment ink MK (third mode) is greater than the ejection capability for the color ink (third and fourth modes). 2-4. The supply capability for the black pigment ink MK (third mode) is greater than the supply capability for the black dye ink PK (fourth mode). 2-5. The supply capability for the black pigment ink MK (third mode) is greater than the supply capability for the color ink (third and fourth modes). 2-6. The ejection capability for the black pigment ink MK (third mode) is equal to or less than the supply capability for the black dye ink PK (fourth mode), and is equal to or less than the supply capability for the color ink (third and fourth modes).

In a case where the apparatus has Feature 2-1, regardless of whether or not a large amount of the ink is ejected on the basis of the raster data which indicates a dot printing state at the time of each main scanning included in the print data PD, the black pigment ink MK may be continuously ejected. Even in this case, the timing of supplying the ink to the nozzle groups is appropriately set. Accordingly, for example, it is not necessary to increase the number of main scanning operations on the basis of the raster data which is included in the print data PD. Hence, it is possible to perform printing at a high speed.

In a case where the apparatus has Features 2-2 and 2-4 in addition to Feature 2-1, the black pigment ink MK can be continuously ejected at a higher speed than continuous ejection of the black dye ink PK. Accordingly, for example, when performing monochrome printing or when making the ejection control different between the color ink and the black ink, it is possible to perform printing in the third mode at a higher speed than printing in the fourth mode.

In a case where the apparatus has Features 2-3 and 2-5 in addition to Feature 2-1, the black pigment ink MK can be continuously ejected at a higher speed than continuous ejection of the color ink. Accordingly, by performing printing through the above-mentioned feeding method of the band feeding or making the ejection control different between the black pigment ink MK and the color ink, it is possible to perform printing using the black pigment ink MK at a higher speed than printing in Comparative Example 1. Feature 2-6 will be described later.

E-3. Ejection Capability and Supply Capability Comparative Example 3

FIG. 14 is a graph illustrating the ejection capabilities and the supply capabilities of the printing apparatus in the modes in Comparative Example 3. In Comparative Example 3, printing is performed on the basis of selection of either one of the first mode and the second mode. As described above, in the first mode, printing is performed using the black pigment ink MK and the color ink. In the second mode, printing is performed using the black dye ink PK and the color ink. In addition, a configuration of the printing apparatus, which performs printing in the first and second modes, is a configuration of the above-mentioned printer 20. The first and second modes in claims correspond to the first and second modes of Comparative Example 3.

In FIG. 14, MK-T1, MK-K1, CMY-T1, CMY-K1, PK-T2, PK-K2, CMY-T2, and CMY-K2 respectively indicate the ejection capability for the black pigment ink MK in the first mode, the supply capability for the black pigment ink MK in the first mode, the ejection capability for the color ink in the first mode, the supply capability for the color ink in the first mode, the ejection capability for the black dye ink PK in the second mode, the supply capability for the black dye ink PK in the second mode, the ejection capability for the color ink in the second mode, and the supply capability for the color ink in the second mode.

As shown in FIG. 14, the third and fourth modes and the printing apparatus using such modes have the following features. 3-1. In either one mode, the supply capability of the printing apparatus for each ink is greater than the ejection capability. 3-2. The ejection capability for the black pigment ink MK (first mode) is greater than the ejection capability for the black dye ink PK (second mode). 3-3. The ejection capability for the black pigment ink MK (first mode) is greater than the ejection capability for the color ink (first and second modes). 3-4. The supply capability for the black pigment ink MK (first mode) is greater than the supply capability for the black dye ink PK (second mode). 3-5. The supply capability for the black pigment ink MK (first mode) is greater than the supply capability for the color ink (first and second modes). 3-6. The ejection capability for the black pigment ink MK (first mode) is greater than the supply capability for the black dye ink PK (second mode). 3-7. The ejection capability for the black pigment ink MK (first mode) is greater than the supply capability for the color ink (first and second modes). 3-8. The ejection capability for the color ink in first mode is greater than the ejection capability for the color ink in the second mode. In addition, the supply capability for the color ink in the first mode is equal to the supply capability for the color ink in the second mode. 3-9. The ejection capability for the color ink in first mode is greater than the ejection capability for the black dye ink PK in the second mode. In addition, the supply capability for the color ink in the first mode is equal to the supply capability for the black dye ink PK in the second mode.

In a case where the apparatus has Feature 3-1, similarly to the case where the apparatus has Feature 2-1, it is possible to perform printing at a high speed.

In a case where the apparatus has Features 3-2 and 3-4 in addition to Feature 3-1, similarly to the case where the apparatus has Feature 2-1, Feature 2-2, and Feature 2-4, it is possible to perform printing in the first mode at a higher speed than printing in the second mode. Further, in a case where the apparatus has Feature 3-6 or 3-7, an excessively small amount of the black pigment ink MK relative to the supply capability is not ejected in the first mode. Hence, it is possible to perform printing in the first mode at a further higher speed. That is, in the case where the apparatus has Feature 2-6, an excessively small amount of the black pigment ink MK relative to the supply capability is likely to be ejected, but in the case where the apparatus has Feature 3-6 or 3-7, the above-mentioned situation is unlikely to occur, compared with the case where the apparatus has Feature 2-6.

In a case where the apparatus has Features 3-3 and 3-5 in addition to Feature 3-1, similarly to the case where the apparatus has Feature 2-1, Feature 2-3, and Feature 2-5, it is possible to perform printing using the black pigment ink MK at a high speed. Further, in a case where the apparatus has Feature 3-6 or 3-7, an excessively small amount of the black pigment ink MK relative to the supply capability is not ejected in the first mode. Hence, it is possible to perform printing in the first mode at a further higher speed. The rest is the same as described above.

In addition, in the above-mentioned printer 20, it is the premise that the supply capability of the injection pipe 72PK is equal to the supply capability of the injection pipes 72Y, 72M, and 72C. However, for example, when the supply capability of the injection pipe 72PK is greater than the supply capability of the injection pipes 72Y, 72M, and 72C, in the case where the apparatus has Feature 3-6, compared with the case where the apparatus has Feature 3-7, an excessively small amount of the black pigment ink MK relative to the supply capability is not ejected in the first mode. Hence, it is possible to perform printing in the first mode at a further higher speed.

A case where the apparatus has Feature 3-8 in addition to Feature 3-1 is described as follows. The supply capability for the color ink in the first mode, the supply capability for the color ink in the second mode, and the supply capability for the black dye ink PK in the second mode are equal to one another. Hence, even though the same ejection is performed, the ejection capability is different between the first mode and the second mode. As described above, when the ejection capability is different between the modes, for example, at least one of the following factors is different: the speed of the carriage 30 during the main scanning; the size of a single ejected ink droplet; the spacing for ink ejection; and the like. As the speed of the carriage 30 during the main scanning becomes lower, it is possible to further reduce a possibility that there may be misalignment in the positions of the ejected ink droplets landed on the printing paper P. Therefore, it can be said that it is possible to perform printing with high quality. Further, as the size of a single ejected ink droplet becomes smaller, it is possible to further reduce granularity by forming fine dots on the printing paper P. Therefore, it can be said that it is possible to perform printing with high quality. Furthermore, as the spacing for the ink ejection becomes longer, it is possible to more minutely control the sizes of the ink droplets by minutely controlling the voltage applied to the electrostrictive element. Therefore, it can be said that it is possible to perform printing with high quality. Alternatively, as the speed of the carriage 30 during the main scanning becomes higher, it is possible to perform printing at a higher speed. In such a manner, modes are set so as to have equivalent supply capabilities and different ejection capabilities. Thereby, it is possible to appropriately perform mode setting and mode selection for high speed printing and high quality printing in accordance with the intended use. Thus, it is possible to improve usability.

In a case where the apparatus has Feature 3-9 in addition to Feature 3-1, similarly to the case where the apparatus has Features 3-1 and 3-8, it is possible to improve usability.

F. Execution of Printing

Figure 15:
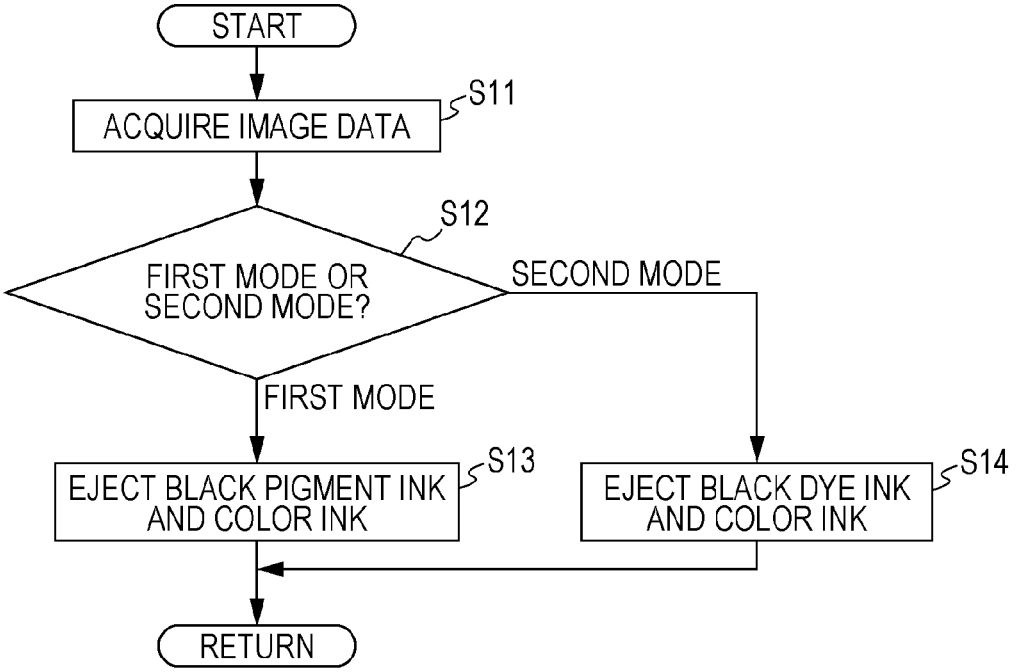
FIG. 15 is a flowchart illustrating a procedure of execution of printing.

FIG. 15 is a flowchart illustrating a procedure of execution of printing. In step S11 of FIG. 15, the printer 20 acquires the print data PD through the connector 56. Next, on the basis of the print data PD, whether printing is performed in the first mode or printing is performed in the second mode is specified (step S12). When printing is performed in the first mode, on the basis of the print data PD, the black pigment ink MK and the color inks are ejected (step S13). When printing is performed in the second mode, on the basis of the print data PD, printing is performed using the black dye ink PK and the color inks (step S14). At this time, the feeding method, the main scanning range, the ejection capability, and the supply capability of each mode are as described above.

As described above, according to the printer 20 of the example, it is possible to perform printing in either one of the first and second modes. Therefore, it is possible to perform printing with high quality at a high speed. Further, by switching between performing printing in the first mode and performing printing in the second mode in accordance with the purpose of an increase in speed or improvement in quality, it is possible to further improve usability.

G. Modification Examples

It should be noted that the invention is not limited to the above-mentioned embodiment, and various modifications and variations may be added to the above-mentioned embodiment. The modification examples will be hereinafter described.

Modification Example 1

The above-mentioned printer 20 performs printing in either one of the first and second modes, but may perform printing in for example at least one of third to sixth modes in addition thereto. In this case, it is possible to perform printing through various modes. Therefore, it is possible to further improve usability. Further, it is not necessary for the first and second modes to have all of the above-mentioned Features 3-1 to 3-9, and the modes may have at least Feature 3-1.

Modification Example 2

Further, in the printing in the first mode, the type of the printing paper P is a plain paper, the type of the black ink is the black pigment ink MK, the feeding method is the band feeding, and the carriage movement speed is a high speed. In the printing in the second mode, the type of the printing paper P is a glossy paper, the type of the black ink is the black dye ink PK, the feeding method is the interlaced feeding, and the carriage movement speed is a low speed. However, the invention is not limited to the above-mentioned combinations. At least one of the type of the printing paper P, the type of the black ink, the feeding method, and the carriage movement speed may be reversed between the above-mentioned first mode and second mode, or may be the same between the first mode and the second mode.

Further, either one of the first and second modes is selected in accordance with the type of the printing paper P, but the invention is not limited to this. For example, by causing a user to select any one of the type of the black ink, the feeding method, and the carriage movement speed, other elements may be specified. Further, by causing a user to select the so-called high speed mode or high quality mode, in the former case, the first mode may be specified, and in the latter case, the second mode may be specified.

Modification Example 3

In the above-mentioned interlaced feeding, dots are formed on a single raster of each color through ejection from a single nozzle. However, the dots may be formed through ejection from two or more nozzles. When there are variations in the ejection direction or the amount of ejection for each nozzle, such variations spread more and are more unlikely to be visible in the case where dots are formed through ejection from two or more nozzles than the case where dots are formed on a single raster through ejection from a single nozzle. As a result, in some cases, it may be possible to perform printing with high quality. However, since the printing mode can be selected in accordance with the purpose such as high speed or high quality, it is preferable to provide at least two modes. In addition, for the purpose such as high speed or high quality, printing may be performed on the basis of the print data PD for printing an image (that is, an image corresponding to twice the length of each of the nozzle groups N11 to N16) corresponding to 40 rasters in the sub-scanning direction SS. In this case, it is preferable that the two modes are modes between which the maximum value of the feeding amount of the sub-scanning feeding is different. When the two modes have such a relationship, it is possible to selectively perform printing according to the purpose such as high speed or high quality.

Modification Example 4

In the above-mentioned printer 20, the injection pipes for the black pigment ink cartridge 171MK are two injection pipes 72MK1 and 72MK2. However, the number of the injection pipes for the black pigment ink cartridge 171MK is not limited to two. For example, even when the number of the injection pipes is one, the diameter of the injection pipe for the black pigment ink cartridge 171MK may be set to be greater than the diameter of the injection pipe for another ink cartridge. In this case, it can be said that the supply capability of the injection pipe for the black pigment ink cartridge 171MK is higher than the supply capability of the injection pipe for another cartridge. Further, the ink supply section in claims is not limited to the injection pipe 72, but it is preferable to supply the ink within the cartridge to the nozzle groups of the printer 20 through the flow passage of the cartridge and the flow passage of the printer 20 which are bonded to each other.

Modification Example 5

In the above-mentioned printer 20, in order from one side to the other side in the main scanning direction MS, the following nozzle groups are arranged: the nozzle group N11 for ejecting the black dye ink PK; the nozzle group N12 for ejecting the yellow ink Y; the nozzle group N13 for ejecting the magenta ink M; the nozzle group N14 for ejecting the cyan ink C; and the nozzle groups N15 and N16 for ejecting the black pigment ink MK. However, the order and the number of nozzle groups for ejecting the inks and the number of nozzles of each nozzle group are not limited to this. For example, the single nozzle group for ejecting the black pigment ink MK and the single nozzle group for ejecting the black dye ink PK may be arranged with the nozzle group for ejecting the color ink interposed therebetween in the main scanning direction MS. In this case, when performing printing by selectively using the black pigment ink MK or the black dye ink PK, it is possible to change the main scanning range in accordance with each case. Therefore, it is possible to perform printing at a high speed. Further, it is not necessary only for the black inks to be provided as the dye ink and the pigment ink, but the color inks may be provided as the dye ink and the pigment ink. In this case, the above-mentioned printing may be performed using the color pigment ink and the color dye ink, instead of the black pigment ink MK and the black dye ink PK in the above-mentioned printer 20.

Modification Example 6

In the above-mentioned embodiment, the ink is ejected using the electrostrictive element. However, a method of ejecting the liquid is not limited to this. For example, another method such as a method of generating bubbles in the nozzle through heat may be used.

Modification Example 7

In the above-mentioned embodiment, relative movement in the main scanning direction MS is performed through the main scanning of the carriage 30, and relative movement in the sub-scanning direction SS is performed through the sub-scanning feeding of the printing paper P. However, the invention is not limited to this. The relative movement in the main scanning direction MS may be performed by moving the printing paper P, and the relative movement in the sub-scanning direction SS may be performed by moving the printing head 28.

Modification Example 8

In the above-mentioned embodiment, the printer 20 is described as the printing apparatus, but the invention is not limited to this. For example, the printing apparatus may be a liquid ejecting apparatus that sprays or ejects a fluid (a liquid or a liquid-like substance in which particles of a functional material are distributed, or a fluid-like substance such as a gel). For example, the technique like the above-mentioned embodiment may be applied to various apparatuses using an ink jet technique. The apparatuses using the ink jet technique includes a color filter manufacturing apparatus, a dyeing apparatus, a microfabrication apparatus, a semiconductor manufacturing apparatus, a surface fabrication apparatus, a three-dimensional modeling apparatus, a gasification apparatus, an organic EL manufacturing apparatus (especially a polymer EL manufacturing apparatus), a display manufacturing apparatus, a deposition apparatus, a DNA chip manufacturing apparatus, and the like. Further, such methods and manufacturing methods are also in the application range. In this case, the fluid, which is sprayed or ejected by the ink jet technique, is included in the above-mentioned ink.

The above-mentioned embodiment is intended to facilitate understanding of the invention, and is not intended to be construed as limiting the invention. Needless to say, the invention can be changed or improved without departing from the spirit thereof, and equivalents thereof are included in the invention.

The entire disclosure of Japanese Patent Application No. 2012-182990, filed Aug. 22, 2012 is expressly incorporated by reference herein.

What is claimed is:

1. A printing apparatus in which a pigment ink supplier for supplying a black pigment ink and a color ink supplier for supplying a color ink can be separately mounted, the printing apparatus comprising:

a head that has a black ink nozzle array, in which a plurality of nozzles for ejecting the black pigment ink is arranged, and a color ink nozzle array in which a plurality of nozzles for ejecting the color ink is arranged;

a pigment ink supply section that supplies the black pigment ink, which is supplied from the pigment ink supplier, to the black ink nozzle array; and a color ink supply section that supplies the color ink, which is supplied from the color ink supplier, to the color ink nozzle array, wherein a supply capability, defined as the volume of ink supply over a unit of time, of the pigment ink supply section is higher than a supply capability of the color ink supply section.

2. The printing apparatus according to claim 1, wherein a dye ink supplier for supplying a black dye ink can be further mounted, wherein the head has a black dye ink nozzle array in which a plurality of nozzles for ejecting the black dye ink is arranged, and wherein a dye ink supply section for supplying the black dye ink, which is supplied from the dye ink supplier, to the black dye ink nozzle array is provided.

3. The printing apparatus according to claim 2, wherein the number of the pigment ink supply sections is larger than the number of the dye ink supply sections.

4. The printing apparatus according to claim 3, wherein the head ejects the color ink by an ejection capability which is equal to or less than the supply capability of the color ink supply section, and wherein the head ejects the black pigment ink by an ejection capability which is equal to or less than the supply capability of the pigment ink supply section and which is greater than a supply capability of the dye ink supply section.

5. The printing apparatus according to claim 2,
wherein a diameter of the pigment ink supply section is larger than a diameter of the dye ink supply section.

6. The printing apparatus according to claim 2,
wherein the color ink nozzle array for ejecting the color ink is provided between one nozzle array for ejecting the black pigment ink and one nozzle array for ejecting the black dye ink in a main scanning direction.

7. The printing apparatus according to claim 2,
wherein a control section causes the head to eject inks onto a medium, on the basis of print data and a certain mode among a plurality of modes including a first mode for ejecting the black pigment ink and a second mode for ejecting the black dye ink,
wherein the second mode is a mode for ejecting the black dye ink by an ejection capability which is equal to or less than the supply capability of the dye ink supply section, and
wherein the first mode is a mode for ejecting the black pigment ink by an ejection capability which is equal to or less than the supply capability of the pigment ink supply section and which is greater than a supply capability of the dye ink supply section.

8. The printing apparatus according to claim 7,
wherein a speed of relative movement in a main scanning direction in the first mode is higher than a speed of relative movement in the main scanning direction in the second mode.

9. The printing apparatus according to claim 1,
wherein the number of the pigment ink supply sections is larger than the number of the color ink supply sections.

10. The printing apparatus according to claim 1,
wherein a diameter of the pigment ink supply section is larger than a diameter of the color ink supply section.

11. The printing apparatus according to claim 1,
wherein the head has a plurality of nozzle arrays for ejecting the black pigment ink, and
wherein the plurality of nozzle arrays for ejecting the black pigment ink ejects the black pigment ink which is supplied from the single pigment ink supplier.

12. A printing apparatus in which a pigment ink supplier for supplying a black pigment ink and a dye ink supplier for supplying a black dye ink can be separately mounted, the printing apparatus comprising:
a head that has a black pigment ink nozzle array, in which a plurality of nozzles for ejecting the black pigment ink is arranged, and a black dye ink nozzle array in which a plurality of nozzles for ejecting the black dye ink is arranged;
a pigment ink supply section that supplies the black pigment ink, which is supplied from the pigment ink supplier, to the black pigment ink nozzle array; and
a dye ink supply section that supplies the black dye ink, which is supplied from the dye ink supplier, to the black dye ink nozzle array,
wherein a supply capability, defined as the volume of ink supply over a unit of time, of the pigment ink supply section is higher than a supply capability of the dye ink supply section.

13. The printing apparatus according to claim 12,
wherein the head has a plurality of nozzle arrays for ejecting the black pigment ink, and
wherein the plurality of nozzle arrays for ejecting the black pigment ink ejects the black pigment ink which is supplied from the single pigment ink supplier.

14. The printing apparatus according to claim 12,
wherein the number of the pigment ink supply sections is larger than the number of the dye ink supply sections.

15. The printing apparatus according to claim 12,
wherein a diameter of the pigment ink supply section is larger than a diameter of the dye ink supply section.

16. The printing apparatus according to claim 12,
wherein a control section causes the head to eject inks onto a medium, on the basis of print data and a certain mode among a plurality of modes including a first mode for ejecting the black pigment ink and a second mode for ejecting the black dye ink,
wherein the second mode is a mode for ejecting the black dye ink by an ejection capability which is equal to or less than the supply capability of the dye ink supply section, and
wherein the first mode is a mode for ejecting the black pigment ink by an ejection capability which is equal to or less than the supply capability of the pigment ink supply section and which is greater than a supply capability of the dye ink supply section.

17. The printing apparatus according to claim 16,
wherein a speed of relative movement in a main scanning direction in the first mode is higher than a speed of relative movement in the main scanning direction in the second mode.

18. The printing apparatus according to claim 12,
wherein a color ink supplier for supplying a color ink can be further mounted,
wherein the head has a color ink nozzle array in which a plurality of nozzles for ejecting the color ink is arranged, and
wherein a color ink supply section for supplying the color ink, which is supplied from the color ink supplier, to the color ink nozzle array is provided.

19. The printing apparatus according to claim 18,
wherein the color ink nozzle array for ejecting the color ink is provided between one nozzle array for ejecting the black pigment ink and one nozzle array for ejecting the black dye ink in a main scanning direction.

20. A printing apparatus in which a first ink supplier for supplying a first ink and a second ink supplier for supplying a second ink can be separately mounted, the printing apparatus comprising:
a head that has a first nozzle array, in which a plurality of nozzles for ejecting the first ink is arranged, and a second nozzle array in which a plurality of nozzles for ejecting the second ink is arranged;
a first ink supply section that supplies the first ink, which is supplied from the first ink supplier, to the first nozzle array;
a second ink supply section that supplies the second ink, which is supplied from the second ink supplier, to the second nozzle array;
a scanning section that performs relative movement between the head and the medium in a main scanning direction which is orthogonal to a direction of the nozzle array; and
a control section that causes the scanning section to perform the relative movement between the head and the medium in the main scanning direction, the control section causing the head to eject inks onto a medium on the basis of print data and a certain mode among a plurality of modes including a first mode for ejecting the first ink and a second mode for ejecting the second ink, wherein a supply capability, defined as the volume of ink supply over a unit of time, of the first ink supply section is higher than a supply capability of the second ink supply section, wherein the second mode is a mode for ejecting the second ink by an ejection capability which is equal to or less than the supply capability of the second ink supply section, and wherein the first mode is a mode for ejecting the first ink by an ejection capability which is equal to or less than the supply capability of the first ink supply section and which is greater than a supply capability of the second ink supply section.

* * * * *